US009714480B2

(12) United States Patent
Rockwell et al.

(10) Patent No.: US 9,714,480 B2
(45) Date of Patent: Jul. 25, 2017

(54) ACOUSTICALLY INSULATED MACHINE

(75) Inventors: Anthony Lee Rockwell, Pickerington, OH (US); Phil Johnson, Louisville, KY (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 878 days.

(21) Appl. No.: 13/114,446

(22) Filed: May 24, 2011

(65) Prior Publication Data

US 2012/0298154 A1 Nov. 29, 2012

(51) Int. Cl.

| | |
|---|---|
| ***A47L 15/02*** | (2006.01) |
| ***D06F 37/00*** | (2006.01) |
| ***G10K 11/16*** | (2006.01) |
| ***D06F 39/12*** | (2006.01) |
| ***A47L 15/42*** | (2006.01) |
| *G10K 11/168* | (2006.01) |

(52) U.S. Cl.
CPC ..... *D06F 39/12* (2013.01); *A47L 15/4209* (2016.11); *G10K 11/168* (2013.01)

(58) Field of Classification Search
CPC .... A47L 15/4255; D06F 39/12; G10K 11/168
USPC ..... 68/3 R; 134/56 D, 57 D, 58 D, 184
See application file for complete search history.

(56) References Cited

U.S. PATENT DOCUMENTS

| | | | |
|---|---|---|---|
| 2,231,063 | A | 6/1943 | Bohnke |
| 2,703,974 | A | 3/1955 | Clark et al. |
| 2,879,655 | A | 3/1959 | McCormick |
| 3,132,098 | A | 5/1964 | Bochan |
| 3,216,225 | A | 11/1965 | Gil |
| 3,268,082 | A | 8/1966 | Galin |
| 3,295,541 | A | 1/1967 | Ummel |

(Continued)

FOREIGN PATENT DOCUMENTS

| | | |
|---|---|---|
| AU | 2002301525 | 12/2003 |
| DE | 2351265 | 7/1975 |

(Continued)

OTHER PUBLICATIONS

International Search Report and Written Opinion from PCT/US11/37701 dated Oct. 3, 2011.

(Continued)

*Primary Examiner* — Michael Barr
*Assistant Examiner* — Benjamin L Osterhout
(74) *Attorney, Agent, or Firm* — Calfee, Halter & Griswold LLP

(57) ABSTRACT

Acoustically insulated machines have an internal source of noise and an insulation member. The insulation member may include a plurality of porous, sound absorbing layers and a plurality of dense or facing layers attached to faces of the sound absorbing layers. The dense or facing layers each have a density that is greater than the densities of the sound absorbing layers. The insulation member may be oriented such that one of the dense or facing layers faces toward the internal source of noise. The insulation member may be configured such that most of the low frequency sound energy generated by the internal source of noise is not reflected back into the machine. That is, the dense or facing layer may be configured to allow a majority of low frequency sound energy from the internal source of noise to pass into the insulation member.

20 Claims, 15 Drawing Sheets

(56) References Cited

U.S. PATENT DOCUMENTS

| | | | |
|---|---|---|---|
| 3,301,428 | A | 1/1967 | Erickson |
| 3,579,609 | A | 5/1971 | Sevenich |
| 4,366,902 | A | 1/1983 | Fanson et al. |
| 4,661,392 | A | 4/1987 | Kapstad |
| 4,889,209 | A | 12/1989 | Sears |
| 4,985,106 | A | 1/1991 | Nelson |
| 5,044,705 | A | 9/1991 | Nelson |
| 5,056,341 | A | 10/1991 | Mori et al. |
| 5,307,928 | A | 5/1994 | Bishop |
| 5,515,702 | A | 5/1996 | Park |
| 5,533,367 | A | 7/1996 | Lybarger et al. |
| 5,570,597 | A | 11/1996 | Bongini |
| 5,647,257 | A | 7/1997 | Maida et al. |
| 5,679,145 | A | 10/1997 | Andersen et al. |
| 5,834,711 | A | 11/1998 | Haines |
| 5,855,353 | A | 1/1999 | Shaffer et al. |
| 5,934,107 | A | 8/1999 | Lee et al. |
| 6,152,259 | A | 11/2000 | Freist et al. |
| 6,196,029 | B1 | 3/2001 | Melia et al. |
| 6,514,889 | B1 | 2/2003 | Theoret et al. |
| 6,539,955 | B1 | 4/2003 | Tilton et al. |
| 6,595,321 | B1 | 7/2003 | Tompson |
| 6,669,265 | B2 | 12/2003 | Tilton et al. |
| 6,807,700 | B2 | 10/2004 | Panther et al. |
| 6,932,190 | B2 | 8/2005 | Sishtla |
| 7,014,160 | B2 | 3/2006 | Muyskens |
| 7,128,561 | B2 | 10/2006 | Rockwell et al. |
| 7,159,836 | B2 | 1/2007 | Parks et al. |
| 7,226,879 | B2 | 6/2007 | Tilton et al. |
| 7,251,962 | B2 | 8/2007 | Lim et al. |
| 7,357,974 | B2 | 4/2008 | Rockwell |
| 7,409,959 | B2 | 8/2008 | Retsema |
| 7,506,776 | B2 | 3/2009 | Podd |
| 7,685,665 | B2 | 3/2010 | Warmuth |
| 7,748,796 | B2 | 7/2010 | Rockwell et al. |
| 7,827,753 | B2 | 11/2010 | Nagarajan et al. |
| D629,556 | S | 12/2010 | Alter et al. |
| 7,923,092 | B2 | 4/2011 | Rockwell |
| 2001/0038722 | A1 | 11/2001 | Stone |
| 2002/0134615 | A1 | 9/2002 | Herreman et al. |
| 2005/0126848 | A1 | 6/2005 | Siavoshai et al. |
| 2005/0191921 | A1 | 9/2005 | Tilton et al. |
| 2006/0008614 | A1 | 1/2006 | Rockwell et al. |
| 2006/0008616 | A1 | 1/2006 | Dean et al. |
| 2006/0011628 | A1 | 1/2006 | Guevara |
| 2006/0090958 | A1 | 5/2006 | Coates et al. |
| 2006/0254854 | A1 | 11/2006 | Herrera et al. |
| 2006/0254855 | A1 | 11/2006 | Loftus et al. |
| 2007/0042156 | A1 | 2/2007 | Rockwell |
| 2007/0054090 | A1 | 3/2007 | Rockwell |
| 2007/0137926 | A1 | 6/2007 | Albin, Jr. et al. |
| 2007/0212970 | A1 | 9/2007 | Rockwell et al. |
| 2007/0243366 | A1 | 10/2007 | Tilton et al. |
| 2007/0272285 | A1 | 11/2007 | Herreman et al. |
| 2008/0128005 | A1 | 6/2008 | Haeberle et al. |
| 2008/0135327 | A1 | 6/2008 | Matsumura et al. |
| 2008/0145630 | A1 | 6/2008 | Rockwell |
| 2008/0160857 | A1 | 7/2008 | Chacko et al. |
| 2008/0236637 | A1 | 10/2008 | Pyo et al. |
| 2008/0289664 | A1 | 11/2008 | Rockwell et al. |
| 2008/0317996 | A1* | 12/2008 | Rockwell ..... B31D 1/00 428/74 |
| 2009/0038980 | A1 | 2/2009 | Rockwell et al. |
| 2009/0094908 | A1 | 4/2009 | Krueger et al. |
| 2009/0113843 | A1* | 5/2009 | Levit et al. ..... 52/745.19 |
| 2009/0224515 | A1 | 9/2009 | Breed et al. |
| 2009/0301022 | A1 | 12/2009 | Rockwell et al. |
| 2010/0024851 | A1 | 2/2010 | Rockwell et al. |
| 2010/0147621 | A1 | 6/2010 | Gillette |
| 2010/0187958 | A1 | 7/2010 | Colon |
| 2011/0069498 | A1 | 3/2011 | Alter et al. |
| 2011/0086214 | A1 | 4/2011 | Rockwell |
| 2011/0186473 | A1 | 8/2011 | Rockwell |
| 2011/0233086 | A1 | 9/2011 | Rockwell et al. |
| 2012/0169194 | A1 | 7/2012 | Maderic et al. |
| 2012/0200210 | A1 | 8/2012 | Rockwell et al. |
| 2013/0174435 | A1 | 7/2013 | Rockwell et al. |
| 2013/0266787 | A1 | 10/2013 | Rockwell et al. |
| 2013/0337205 | A1 | 12/2013 | Rockwell et al. |
| 2014/0230497 | A1 | 8/2014 | Rockwell et al. |
| 2015/0097472 | A1 | 4/2015 | Rockwell |
| 2015/0218803 | A1 | 8/2015 | Rockwell |
| 2015/0233110 | A1 | 8/2015 | Alter et al. |
| 2015/0250375 | A1 | 9/2015 | Rockwell et al. |
| 2015/0368852 | A1 | 12/2015 | Rockwell et al. |

FOREIGN PATENT DOCUMENTS

| | | |
|---|---|---|
| DE | 102005031487 | 7/2006 |
| EP | 591826 | 4/1994 |
| EP | 1751341 | 1/2011 |
| JP | 53133194 | 11/1978 |
| WO | 2004/103851 | 12/2004 |
| WO | 2005/100674 | 10/2005 |
| WO | 2011/084953 | 7/2011 |
| WO | 2011/849653 | 7/2011 |

OTHER PUBLICATIONS

International Search Report and Written Opinion from PCT/US11/20124 dated Aug. 4, 2011.
Office action from U.S. Appl. No. 13/339,989 dated Jul. 30, 2015.
Notice of Allowance from U.S. Appl. No. 13/339,989 dated Feb. 16, 2016.
Office action from U.S. Appl. No. 13/339,989 dated Jun. 16, 2016.
International Search Report from PCT/US11/020129 dated Mar. 23, 2011.
International Search Report from PCT/US11/29943 dated Sep. 19, 2011.
Office action from U.S. Appl. No. 12/984,455 dated Sep. 12, 2013.
Office action from U.S. Appl. No. 12/984,455 dated Jun. 4, 2014.
Office action from U.S. Appl. No. 12/964,455 dated Sep. 12, 2014.
Office action from U.S. Appl. No. 12/984,455 dated Nov. 21, 2014.
Office action from U.S. Appl. No. 12/984,455 dated Mar. 13, 2015.
Office action from U.S. Appl. No. 12/984,455 dated Apr. 6, 2016.
Office action from U.S. Appl. No. 13/499,756 dated Apr. 23, 2015.
Office action from U.S. Appl. No. 13/499,756 dated Oct. 2, 2015.
Office action from U.S. Appl. No. 13/339,989 dated Jan. 19, 2017.

* cited by examiner

ACOUSTICALLY INSULATED MACHINE

ACOUSTICALLY INSULATED MACHINE

This invention relates in general to acoustically insulated machines. More particularly, this invention pertains to noise generating machines that are acoustically insulated with a multi-layer sound absorbing member or assembly.

BACKGROUND OF THE INVENTION

Appliances and other machines that generate noise are usually provided with acoustical insulation to reduce the levels of emanating sound. The unwanted sound from these machines can be caused both by the mechanical operation of the motor or other mechanical component within the machine and by the vibration of the machine itself. In a residential dwelling, excessive noise may be generated by dishwashers, clothes washers, clothes dryers, refrigerators, freezers, and microwave ovens, which can be annoying to inhabitants of the dwelling.

Conventional acoustical treatments for machines generally comprises sound transmission barriers and sound absorption layers. One form of acoustical insulation involves enclosing the noise source in an insulation structure. A typical form of acoustical insulation is a layer of mineral fiber insulation, such as fiberglass insulation, wrapped around or positioned around the source of unwanted noise. For example, a fiberglass absorber is usually incorporated in the front door panel of an under-the-counter dishwasher. The blanket of glass fibers absorbs some of the sound energy entering the fiberglass absorber, thereby resulting in a reduced transmission of unwanted sound from the source of sound in the appliance. Further, it is known that the insertion of a reflecting sound barrier within the acoustical insulation also reduces the sound transmission through the insulation product.

Thermoplastic blanket materials are well known in the art. Such materials have been utilized as acoustical and thermal insulators and liners for application to appliances. These insulators and liners typically rely upon both sound absorption, i.e. the ability to absorb incident sound waves and transmission loss, i.e. the ability to reflect incident sound waves, in order to provide sound attenuation. An example of a multilayer thermoplastic blanket having densified layers is disclosed by U.S. Pat. No. 7,357,974, which is incorporated herein by reference in its entirety.

SUMMARY

The present application discloses exemplary embodiments of acoustically insulated machines. One such acoustically insulated machine has an internal source of noise and an insulation member. The insulation member may include a plurality of porous, sound absorbing layer and a plurality of dense or facing layers. The dense or facing layers each have a density that is greater than the densities of the sound absorbing layers. The insulation member may be oriented such that one of the dense or facing layers faces toward said internal source of noise.

In one exemplary embodiment, the insulation member may be configured such that most of the sound energy in a low frequency range, such as 100 to 800 Hz, generated by the internal source of noise is not reflected back into the machine. For example, a dense or facing layer that faces toward the source of noise may be configured to allow a majority of acoustic airborne energy in the low frequency range from the internal source of noise to pass into the dense or facing layer and the sound absorbing layer. That is, less than 50% of the acoustic airborne energy from the internal source of noise in the low frequency range is reflected by the dense or facing layer.

The acoustically insulated machines may take a wide variety of different forms. The acoustically insulated machine may be a clothes washing machine, a dishwasher, an air conditioner, a microwave oven, or any other household machine or appliance that makes noise. For example, an acoustically insulated washing machine may include a cabinet, a washing assembly, a motor, and an acoustic insulation member. The cabinet may have a front or top opening for accepting clothes and a bottom opening. The washing assembly is disposed in the cabinet and is configured to accept clothes to be washed by the washing machine through the front or top opening. The motor assembly is disposed in the cabinet and is coupled to the washing assembly for operating the washing assembly. The acoustic insulation member may be disposed in the bottom opening of the cabinet. In one exemplary embodiment, the acoustic insulation element is soft and flexible, such that the acoustic insulation member is assembled with the cabinet by folding up and/or compressing the acoustic insulation member, placing the acoustic insulation member in the bottom opening of the cabinet, and unfolding and/or decompressing the insulation member such that the acoustic insulation member engages the bottom opening. For example, the acoustic insulation member may engage a lip portion of the bottom opening. The engagement of the lip by the acoustic insulation member retains the acoustic insulation member in the bottom opening.

Another exemplary embodiment of an acoustically insulated machine is an acoustically insulated dishwasher. An acoustically insulated dishwasher may include a housing, a pump, a drive motor, a plate closing a front side of the housing, and an insulation member. The housing may include a washing chamber and an access door. A plurality of legs may support the housing. The pump and drive motor may be provided in a cavity between the legs and below the housing. The plate closes a front side of the cavity. The insulation member is disposed between the plate and the pump and drive motor. The insulation member may be oriented such that an outer dense or facing layer faces toward the pump and drive motor. The outer dense or facing layer may be configured to allow a majority of sound energy in a low frequency range, such as 100 to 800 Hz, from the pump and drive motor to pass into the dense or facing layer and the first sound absorbing layer.

In the following description there is shown and described several embodiments of this invention simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings are incorporated in and form a part of this specification, illustrate several aspects of the present invention, and together with the description serve to explain certain principles of the invention. In the drawings.

DESCRIPTION OF EMBODIMENTS

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

Figure 1:
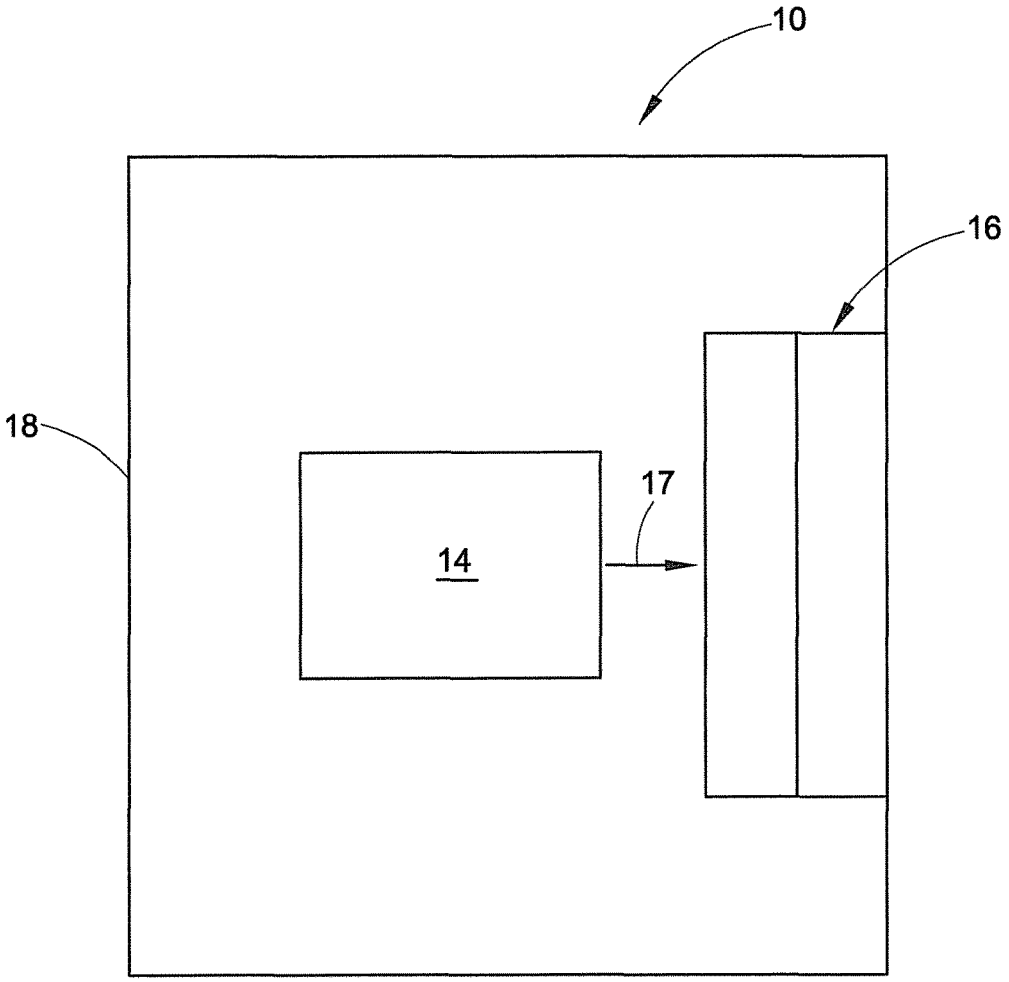
FIG. 1 is a schematic illustration of an exemplary embodiment of an acoustically insulated machine.

The present application discloses exemplary embodiments of acoustically insulated machines 10. Referring to FIG. 1, one such acoustically insulated machine 10 has an internal source of noise 14 and an insulation member 16. The insulation member 16 absorbs sound energy 17 generated by internal source of noise 14 to make the machine 12 quieter. In the example illustrated by FIG. 1, the machine includes a cabinet 18 or housing and the insulation member 16 is disposed inside the cabinet 18. However, the insulation member may be disposed outside of the cabinet 18 in other embodiments.

The insulation member 16 may take a wide variety of different forms. In the exemplary embodiment illustrated by FIG. 1, the insulation member 16 includes a plurality of porous, sound absorbing layers 20 and a plurality of dense or facing layers 22 attached to faces of the sound absorbing layers. The dense or facing layers 22 have a density that is greater than a density of the sound absorbing layers. Referring to FIGS. 2A and 2C, the combination of porous, sound absorbing layers 20 and dense or facing layers allows a thin insulation member 16 to provide the sound absorbing effectiveness of a much thicker acoustic insulation member 26 that is made only from porous, sound absorbing material.

In the example of FIG. 2A, low frequency sound energy 17 from the source of noise 14 hits a first dense or facing layer 22*a*. The low frequency sound energy may be sound energy in a frequency range of 100 to 800 Hz, a frequency range of 100 to 400 Hz, a frequency range of 100 to 200 Hz, a frequency range of 100 to 150 Hz, or a frequency range of 100 to 125 Hz. The wavelengths of the low frequency sound energy are long enough that a portion 32 of the low frequency sound energy 17 is reflected by the dense or facing layer 22*a* and the rest (i.e. a majority) of the low frequency sound energy passes into the first dense or facing layer. A majority and in some cases, substantially all or all high frequency sound energy is reflected by the first dense or facing layer. For example, the high frequency sound energy may be sound energy at a frequency that is higher than 800 Hz This high frequency sound energy is reflected back into the machine by the facing layer 22*a*. However, since the wavelength of the high frequency energy is short, the high frequency sound energy dissipates before it finds another path out of the machine.

In one exemplary embodiment, the reflected portion 32 of low frequency airborne acoustic energy or low frequency sound energy is less than fifty percent of the low frequency airborne acoustic energy or low frequency sound energy 17 that hits the first dense or facing layer 22*a*. For example, the reflected portion 32 may be 50%, less than or equal to 45%, less than or equal to 40%, less than or equal to 35%, less than or equal to 30%, less than or equal to 25%, less than or equal to 20%, less than or equal to 15%, or less than or equal to 10% of the low frequency airborne acoustic energy or low frequency sound energy 17. The reflected portion 32 may escape the cabinet 18 at other locations. As such, reducing the reflected portion 32 may reduce the overall low frequency sound energy that escapes from the cabinet 18 (FIG. 1).

Some of the low frequency sound energy that passes into the first dense or facing layer 22*a* may be absorbed by the first dense or facing layer. Low frequency sound energy that is not absorbed by the first dense or facing layer passes into the first porous, sound absorbing layer 20*a*. Some of the low frequency sound energy that passes into the first porous, sound absorbing layer 20*a* is absorbed by the first porous, sound absorbing layer 20*a*. A remaining portion 38 hits a second dense or facing layer 22*b*. A portion 40 of the low frequency sound energy 38 is reflected back into the first porous, sound absorbing layer 20*a* by the dense or facing layer 22*b* and the rest of the low frequency sound energy passes into the second dense or facing layer 22*b*. In one exemplary embodiment, the reflected portion 40 of low frequency sound energy is less than fifty percent of the low frequency sound energy 38 that hits the second dense or facing layer 22*b*. For example, the reflected portion 40 may be 50%, less than or equal to 45%, less than or equal to 40%, less than or equal to 35%, less than or equal to 30%, less than or equal to 25%, less than or equal to 20%, less than or equal to 15%, or less than or equal to 10% of the low frequency sound energy 38.

Some of the low frequency sound energy that passes into the second dense or facing layer 22*b* is absorbed by the second dense or facing layer. Low frequency sound energy 48 that is not absorbed by the second dense or facing layer passes into the second porous, sound absorbing layer 20*b*. Some of the low frequency sound energy 48 that passes into the second porous, sound absorbing layer 20*b* is absorbed by the second porous, sound absorbing layer 20*b*. A portion 52 of the low frequency sound energy 48 passes out of the acoustic insulator 16. This low frequency sound energy 52 is much less than the low frequency sound energy 17 that initially hit the member 16.

As can be seen from FIG. 2A, the reflected portion 40 bounces back into the porous, sound absorbing layer 20*a*. A portion of this low frequency sound energy 40 is absorbed by the first porous, sound absorbing layer 20*a* and a remaining portion hits the first dense or facing layer 22*a*. As such, the arrangement of dense or facing layers and porous layers allow a majority of the low frequency sound energy to enter the insulation member, trap a majority of the low frequency sound energy, and allow only a small portion 52 of the low frequency sound energy to pass through the insulation member. Referring to FIG. 2C, the small portion of low frequency sound energy 52 is comparable to the portion of low frequency sound energy that passes through a much thicker insulation member that is made only of porous, sound absorbing material.

Figure 2B:
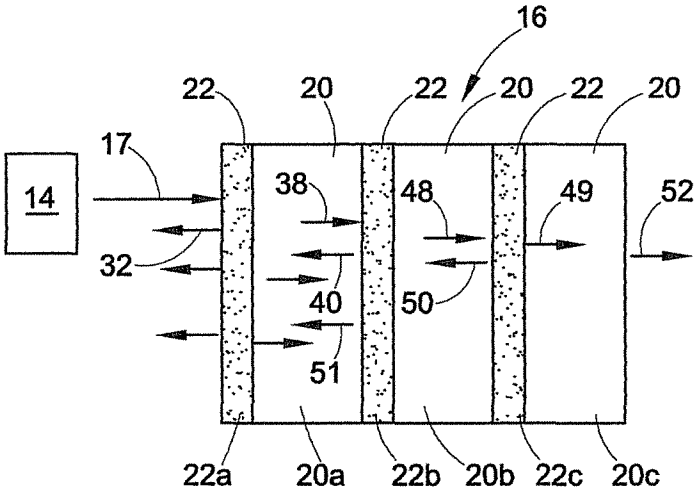
FIG. 2B is a schematic illustration of a multi-layer acoustic insulation member.
Figure 2A:
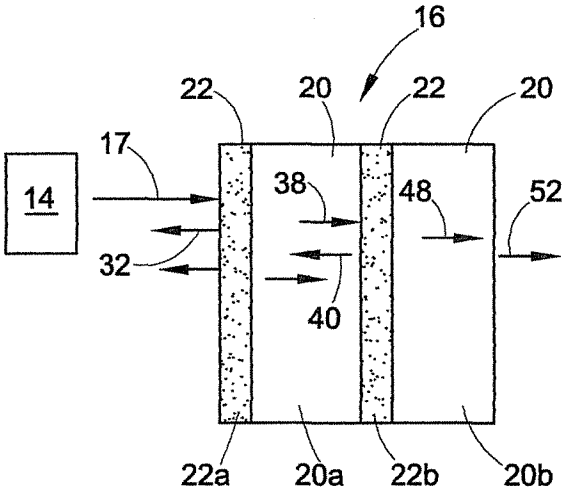
FIG. 2A is a schematic illustration of a multi-layer acoustic insulation member.
Figure 2C:
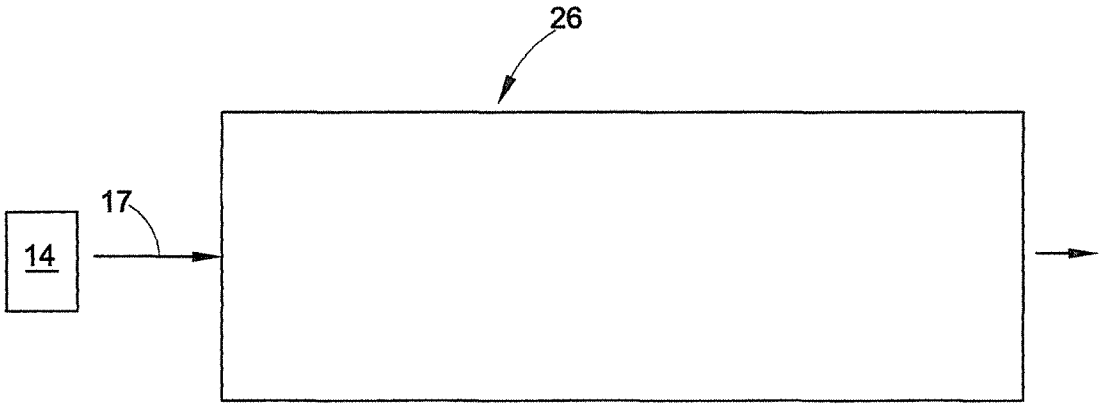
FIG. 2C is a schematic illustration of a single layer acoustic insulation member.

In the example of FIG. 2B, low frequency sound energy 17 or low frequency airborne acoustic energy from the source of noise 14 hits a first dense or facing layer 22*a*. A portion 32 of the low frequency sound energy 17 is reflected by the dense or facing layer 22*a* and the rest of the low frequency sound energy passes into the first dense or facing layer 22*a*. In one exemplary embodiment, the reflected portion 32 of low frequency sound energy is less than fifty percent of the low frequency sound energy 17 that hits the first dense or facing layer 22*a*. For example, the reflected portion 32 may be 50%, less than or equal to 45%, less than or equal to 40%, less than or equal to 35%, less than or equal to 30%, less than or equal to 25%, less than or equal to 20%, less than or equal to 15%, or less than or equal to 10% of the low frequency sound energy 17. The reflected portion 32 may escape the cabinet 18 at other locations. As such, reducing the reflected portion 32 may reduce the overall low frequency sound energy that escapes from the cabinet 18 (FIG. 1).

Some of the low frequency sound energy that passes into the first dense or facing layer 22*a* is absorbed by the first dense or facing layer. Low frequency sound energy that is not absorbed by the first dense or facing layer passes into the first porous, sound absorbing layer 20*a*. Some of the low frequency sound energy that passes into the first porous, sound absorbing layer 20*a* is absorbed by the first porous, sound absorbing layer 20*a*. A remaining portion 38 hits a second dense or facing layer 22*b*. A portion 40 of the low frequency sound energy 38 is reflected back into the first porous, sound absorbing layer 20*a* by the dense or facing layer 22*b* and the rest of the low frequency sound energy passes into the second dense or facing layer 22*b*. In one exemplary embodiment, the reflected portion 40 of low frequency sound energy is less than fifty percent of the low frequency sound energy 38 that hits the second dense or facing layer 22*b*. For example, the reflected portion 38 may be 50%, less than or equal to 45%, less than or equal to 40%, less than or equal to 35%, less than or equal to 30%, less than or equal to 25%, less than or equal to 20%, less than or equal to 15%, or less than or equal to 10% of the low frequency sound energy 38.

Some of the low frequency sound energy that passes into the second dense or facing layer 22*b* is absorbed by the second dense or facing layer. Low frequency sound energy that is not absorbed by the second dense or facing layer passes into the second porous, sound absorbing layer 20*b*. Some of the low frequency sound energy that passes into the second porous, sound absorbing layer 20*b* is absorbed by the second porous, sound absorbing layer 20*b*. A remaining portion 48 hits a third dense or facing layer 22*c*. A portion 50 of the low frequency sound energy 48 is reflected back into the second porous, sound absorbing layer 20*b* by the dense or facing layer 22*c* and the rest of the low frequency sound energy passes into the third dense or facing layer 22*c* and a third porous, sound absorbing layer 20*c*. In one exemplary embodiment, the reflected portion 50 of low frequency sound energy is less than fifty percent of the low frequency sound energy 48 that hits the third dense or facing layer 22*c*. For example, the reflected portion 50 may be 50%, less than or equal to 45%, less than or equal to 40%, less than or equal to 35%, less than or equal to 30%, less than or equal to 25%, less than or equal to 20%, less than or equal to 15%, or less than or equal to 10% of the low frequency sound energy 48.

Some of the low frequency sound energy that passes into the third dense or facing layer 22*c* and the third porous, sound absorbing layer 20*c* is absorbed by the third dense or facing layer and the third porous, sound absorbing layer 20*c*. Low frequency sound energy 52 that is not absorbed by the third dense or facing layer 22*c* and the third porous, sound absorbing layer 20*c* exits the insulation member 16. This low frequency sound energy 52 is much less than the low frequency sound energy 17 that initially hit the member 16.

As can be seen from FIG. 2B, the reflected low frequency sound energy 50 bounces back into the porous, sound absorbing layer 20*b*. A portion of this low frequency sound energy 50 is absorbed by the second porous, sound absorbing layer 20*b* and a remaining portion hits the second dense or facing layer 22*b*. Similarly, the reflected low frequency sound energy 40 bounces back into the porous, sound absorbing layer 20*a* and a portion 51 of low frequency sound energy 50 that was reflected back into the second porous, sound absorbing layer 20*b* may pass through the second dense or facing layer 22*b* into the porous, sound absorbing layer 20*a*. A portion of this low frequency sound energy 40, 51 is absorbed by the first porous, sound absorbing layer 20*a* and a remaining portion hits the first dense or facing layer 22*a*. As such, the arrangement of dense or facing layers and porous layers allow a majority of the low frequency sound energy to enter the insulation member, trap a majority of the low frequency sound energy, and allow only a small portion 52 of the low frequency sound energy to pass through the insulation member. Referring to FIGS. 2B and 2C, the small portion of low frequency sound energy 52 may be comparable to or less than the portion of low frequency sound energy that passes through a much thicker insulation member that is made only of porous, sound absorbing material.

Figure 3:
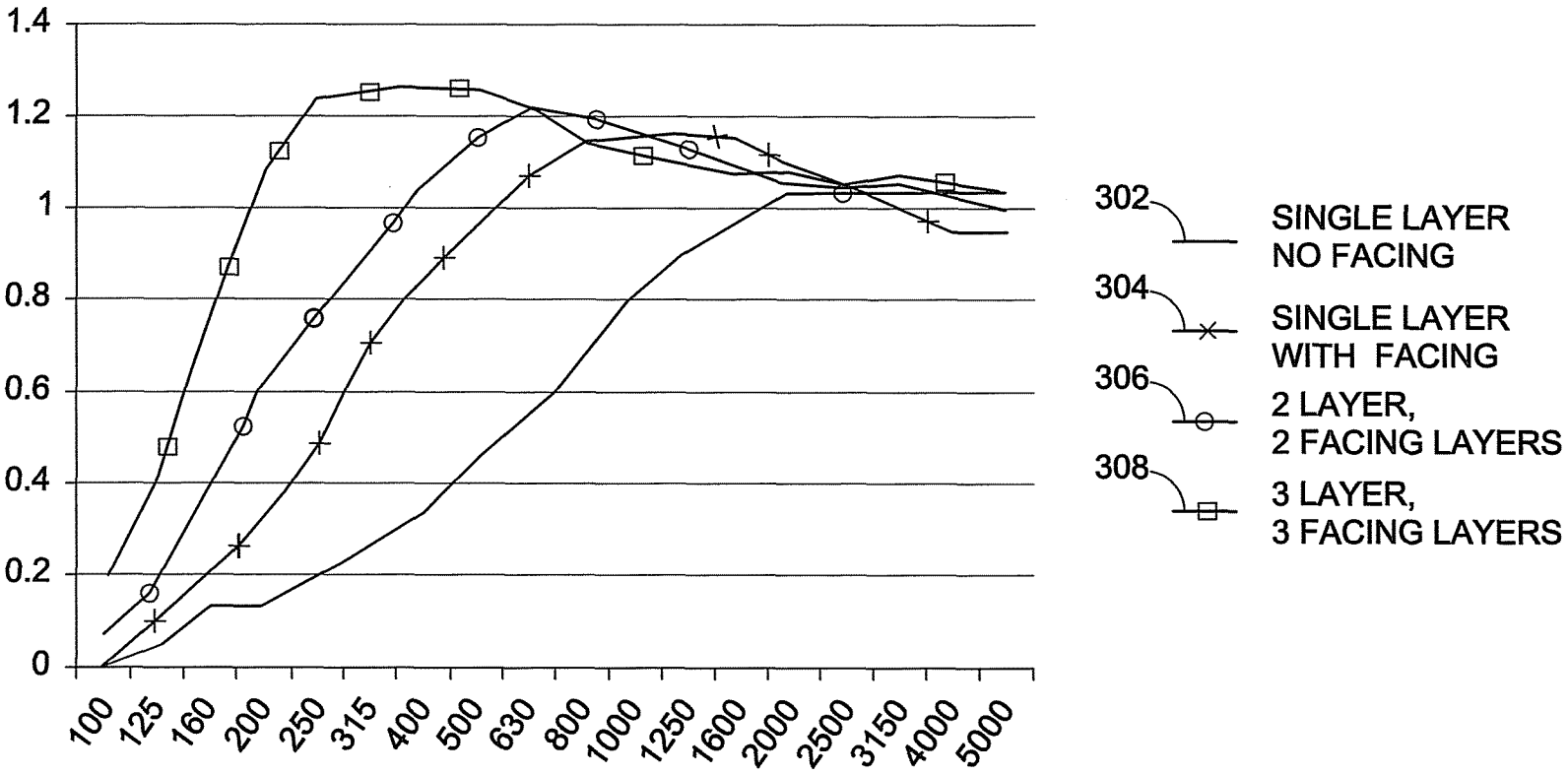
FIG. 3 is a graph illustrating sound absorption performance of acoustic insulation members.

The graph of FIG. 3 illustrates the effect of the multi-layer arrangement of the porous, sound absorbing layers 20 and dense or facing layers 22 illustrated by FIGS. 2A and 2B. In FIG. 3, an absorption coefficient (y-axis), which is a measure of the absorptive effectiveness of the insulation member, is plotted vs. noise frequencies (x-axis) for four different insulation members. The first plot 302 represents the performance of an acoustic insulation member that comprises a porous, lofted sound absorbing layer 20 having a thickness T and single thin facing layer 22. The second plot 304 represents the performance of an acoustic insulation member that comprises a porous, lofted sound 2T and a single thin facing layer 22. The third plot 306 represents the performance of an acoustic insulation member 16 constructed in accordance with FIG. 2A, where the first porous, sound absorbing layer 20*a* has a thickness T and the second porous, sound absorbing layer 20*b* has a thickness 2T. The fourth plot 308 represents the performance of an acoustic insulation member 16 constructed in accordance with FIG. 2B, where the first sound absorbing layer 20*a* has a thickness T, the second sound absorbing layer 20*b* has a thickness 2T, and the third sound absorbing layer 20*c* has a thickness 2T.

As can be seen from the graph of FIG. 3 the multi-layer arrangements of multiple porous, sound absorbing layers 20 and multiple dense or facing layers 22 significantly enhances the performance of the insulation member 16, especially in a low frequency range of between 100 and 500 Hz, and most especially around 125 Hz. As can be seen from the graph of FIG. 3, the multi-layer arrangements have more than an additive effect on the absorption performance, especially in low frequency ranges, such as at frequencies between 100 Hz and 200 Hz. For example, at 125 Hz, the absorption performance coefficient of the 2 absorptive layer/2 facing layer insulation member (plot 306) is about 15-20% more than the absorption performance coefficients of the two 1 absorptive layer/1 facing layer (plots 302, 304) added together. In addition, at 125 Hz, the absorption performance coefficient of the 3 absorptive layer/3 insulation member (plot 308) is about 50% more than the absorption performance coefficient of the 2 absorptive layer/2 facing layer insulation member (plot 306) added to the 1 absorptive layer/1 absorptive layer (plot 304- i.e. 2T thickness plot). As such, adding the second and third absorptive/facing layers increases the absorptive performance coefficient in a substantially exponential manner. This substantially increased acoustical absorption performance is especially useful in machines having motors and pumps that generate noise in a low frequency range, such as frequencies around 125 Hz. For example, the increased acoustical performance is beneficial in a dishwasher or washing machine that generates noise in a low frequency range, such as frequencies around 125 Hz.

The porous, sound absorbing layers 20 may be made from a wide variety of different materials. For example, the porous, sound absorbing layer 20 may be made from thermoplastic polymers, such as polyester, polyethylene terephthalate (PET) polypropylene and the like. In one exemplary embodiment, the sound absorbing layer 20 is made from a fine fiber PET material, such as a 2 denier fiber size PET material. The porous, sound absorbing layers 20 may be formed with a variety of different densities and lofts, which can be selected to adjust the acoustic performance of the insulation member 16. In one exemplary embodiment, the porous, sound absorbing layer 20 is 15-300 grams per square foot and a thickness range of 0.5"-3". For example, in the embodiments illustrated by FIGS. 2A and 2B, the first sound absorbing layer 20*a* may be a PET material, such as VersaMat 2110 (available from Owens Corning) that is 20-25 grams per square foot with a thickness of about ¾", the second sound absorbing layer 20*b* may be a PET material, such as VersaMat 2110 that is 60-80 grams per square foot with a thickness of about 1½", and the third sound absorbing layer 20*c* (FIG. 2B) may be a PET material, such as VersaMat 2110 that is 60-80 grams per square foot with a thickness of about 1½". However, any combination of materials, lofts, and densities may be selected or changed to achieve different acoustic performance characteristics.

The facing layers 22 can take a wide variety of different forms. In an exemplary embodiment, the facing 22 is a relatively permeable layer that allows noise and air to pass through the facing member. For example, the facing layers 22 have an airflow resistance between about 600-1400 Rayls. The facing layers may have an airflow resistance between 900-1400 Rayls. The facing layers 22 may be selected to have an airflow resistance of about 900 Rayls, about 1100 Rayls, or about 1400 Rayls. However, other airflow resistances can be selected. In one exemplary embodiment, the facing layers 22 in the embodiments illustrated by FIGS. 2A and 2B have an airflow resistance of about 900, 1100 and/or 1400 Rayls.

The facing layers 22 can be made from a wide variety of different materials and may have a variety of different thicknesses. For example, any material having the airflow resistance described above can be used. Examples of acceptable materials for the facing layers 22 include, but are not limited to polypropylene, PET, non-porous materials that are perforated to allow airflow, such as perforated metal foil, perforated polymer material, such as a Teflon sheet that has been perforated to allow airflow.

The facing layer 22 may have a wide variety of different densities and thicknesses. In an exemplary embodiment, the facing is much denser than the sound absorbing layer 20. For example, in the embodiments illustrated by FIGS. 2A and 2B, the dense or facing layers 22*a*, 22*b*, 22*c* may be a polypropylene material, such as a spunbond/meltblown/spunbond sheet that is 50 grams per square meter (gsm) The facing layer 22 can have any thickness. For example, the facing layer 22, when made from a polymer such as polypropylene or PET, may be between 0.01 and 0.1 cm thick.

The facing layers 22 and the sound absorbing layers 20 can be assembled in a wide variety of different manners. In one exemplary embodiment, a facing layer 22 is bonded to one or both of the faces of the sound absorbing layer 20 to form a porous/dense laminate 21. The facing layer(s) 22 may be bonded to the sound absorbing layer(s) in a wide variety of different ways. For example, the facing layer 22 may laminated to the sound absorbing layer 20 using heat and/or pressure or the facing layer may be bonded to the sound absorbing layer with an adhesive.

Figure 11A:
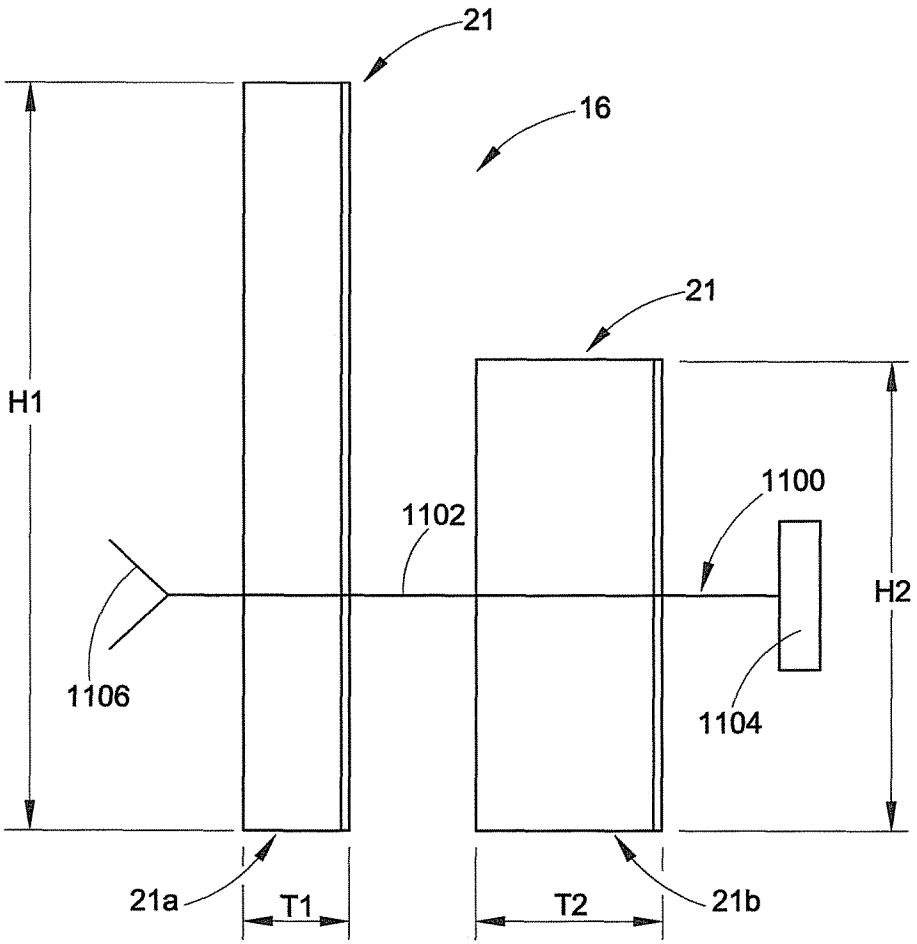
FIG. 11A is a schematic illustration of an exemplary embodiment of an acoustic insulation member having two porous, sound absorbing layers and two dense or facing layers.
Figure 11B:
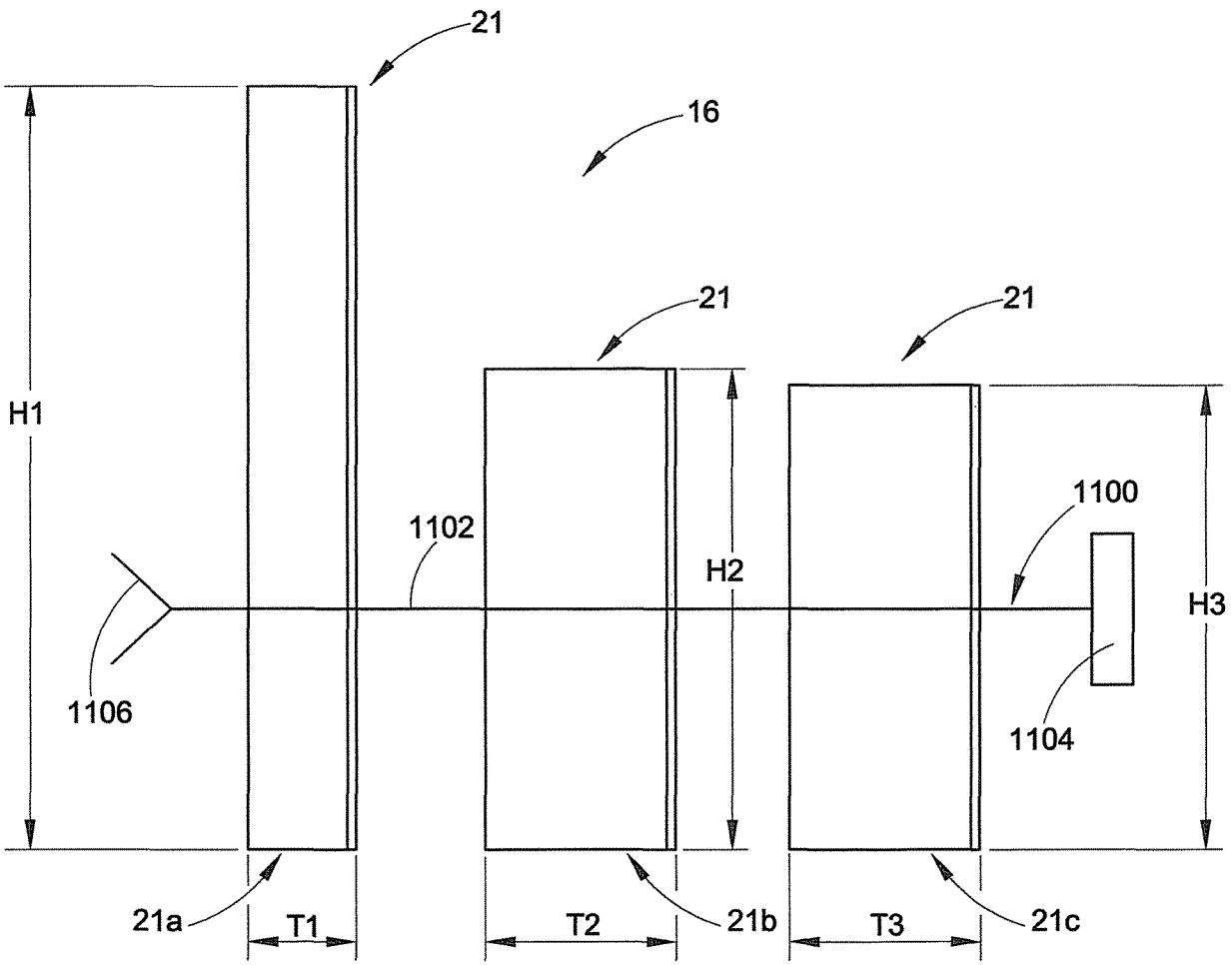
FIG. 11B is a schematic illustration of an exemplary embodiment of an acoustic insulation member having three porous, sound absorbing layers and three dense or facing layers.

Referring to FIGS. 11A and 11B, the porous/dense laminates 21 may be assembled together in a wide variety of different ways. In FIG. 11A, two laminates 21*a*, 21*b* having different thicknesses T1, T2 and heights H1, H2 are assembled together. In FIG. 11B, three laminates 21*a*, 21*b*, 21*e* having thicknesses T1, T2, T3 and heights H1, H2, H3 are assembled together. The thicknesses T1, T2, T3 and heights H1, H2, H3 may be the same or different. In the embodiment illustrated by FIGS. 11A and 11B, the laminates 21 are held or clamped together with a fastener 1100, rather than being bonded together. For example, a plastic strand 1102 (length exaggerated in FIGS. 11A and 11B), such as a nylon or polypropylene strand, with enlarged ends 1104, 1106 extends through the laminates 21*a*, 21*b* and holds the laminates together. An example of a plastic strand with enlarged ends 1104, 1106 is a clothing price tag or label attachment. However, a wide variety of different fasteners can be used. In another embodiment, the laminates are bonded together. The laminates 21 may be bonded together in a wide variety of different ways. For example, the laminates 21 may be bonded together using heat and/or pressure or an adhesive may be used.

The insulation member 16 may take a wide variety of different forms, be made from a wide variety of different materials, and may be made in a wide variety of different ways. The insulation member or member 16 may have any number of porous, sound absorbing layers 20 and dense or facing layers 22. For example, the insulation member 16 may include any number of alternating dense or facing layers 22 and porous, sound absorbing layers 20 with one porous, sound absorbing layer at one outer surface and one dense or facing layer at the other outer surface, any number of alternating dense or facing layers 22 and porous, sound absorbing layers 20 with porous, sound absorbing layers at the outer surfaces, and/or any number of alternating dense or facing layers 22 and porous, sound absorbing layers 20 with dense or facing layers at the outer surfaces. Any arrangement of porous, sound absorbing layers 20 and dense or facing layers 22 can be used.

Figure 5:
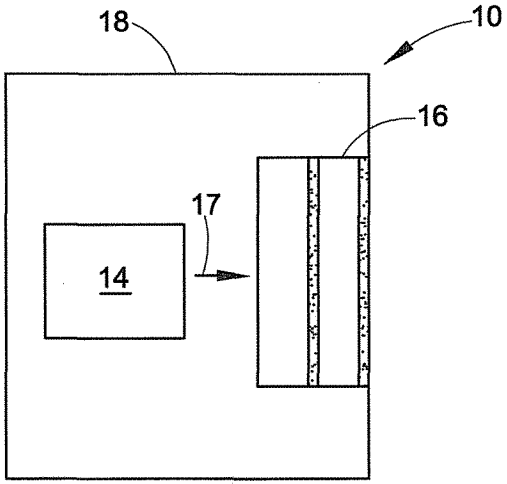
FIG. 5 is a schematic illustration of an exemplary embodiment of an acoustically insulated machine having a multi-layer acoustic insulation member.
Figure 4:
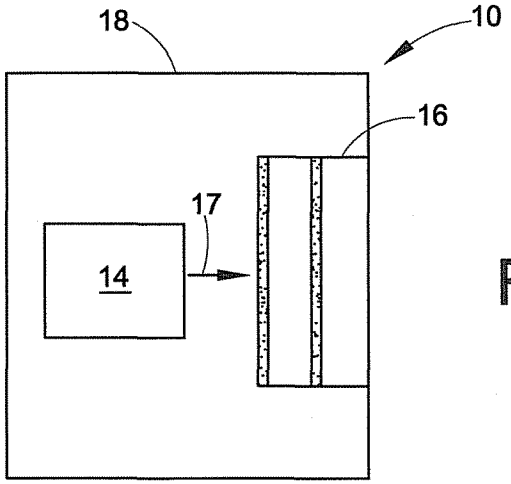
FIG. 4 is a schematic illustration of an exemplary embodiment of an acoustically insulated machine having a multi-layer acoustic insulation member.
Figure 6:
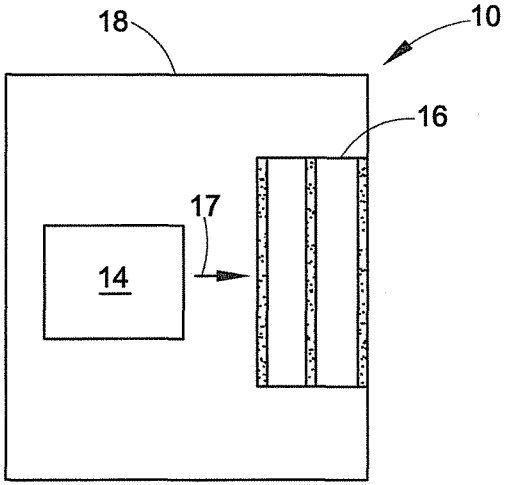
FIG. 6 is a schematic illustration of an exemplary embodiment of an acoustically insulated machine having a multi-layer acoustic insulation member.

Referring to FIGS. 4-6, the insulation member 16 may be positioned and oriented within the cabinet 18 of the machine 10 in a variety of different ways to reduce the amount of sound energy generated by the internal source of noise 14 that leaves the cabinet. In the examples illustrated by FIGS. 4-6, the insulation member 16 is disposed inside the cabinet. The insulation member 16 may be disposed inside any of the walls of the cabinet. In the examples illustrated by FIGS. 4 and 6, the insulation member 16 is oriented such that a dense or facing layer 22 faces toward the internal source of noise 14. In one exemplary embodiment, the dense or facing layer 22 that faces the source of noise 14 is configured to allow a majority of low frequency sound energy from the internal source of noise 14 to pass into the dense or facing layer 22 and into the sound absorbing layer 20 (i.e. less than ½ of the low frequency sound energy is reflected back into the machine). In the example illustrated by FIG. 5, the insulation member 16 is oriented such that a porous, sound absorbing layer 20 faces toward the internal source of noise 14.

Figure 8:
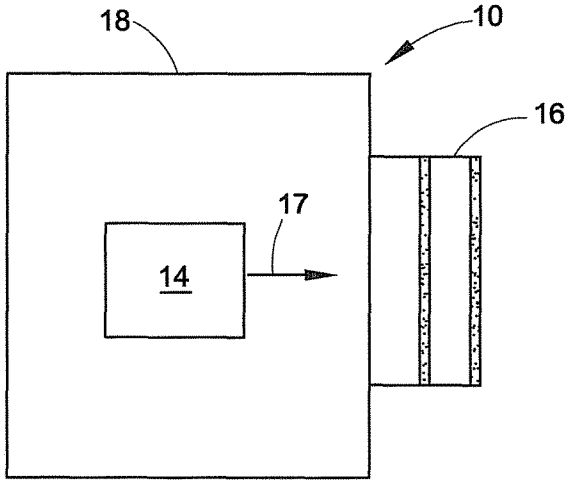
FIG. 8 is a schematic illustration of an exemplary embodiment of an acoustically insulated machine having a multi-layer acoustic insulation member.
Figure 7:
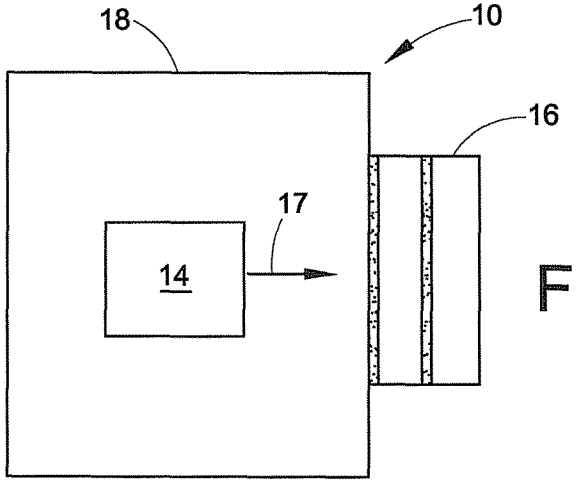
FIG. 7 is a schematic illustration of an exemplary embodiment of an acoustically insulated machine having a multi-layer acoustic insulation member.
Figure 9:
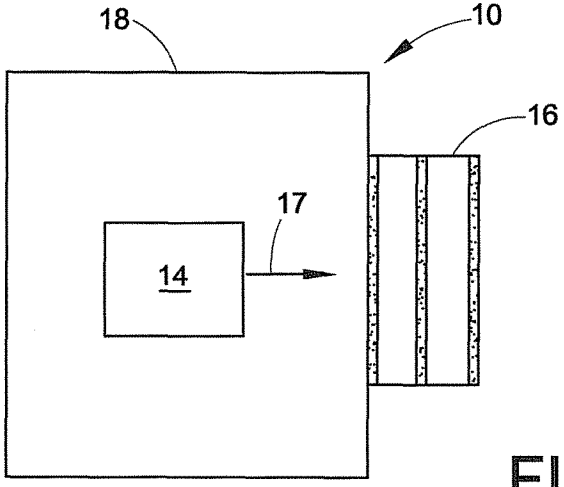
FIG. 9 is a schematic illustration of an exemplary embodiment of an acoustically insulated machine having a multi-layer acoustic insulation member.

In the examples illustrated by FIGS. 7-9, the insulation member 16 is disposed outside the cabinet. The insulation member 16 may be disposed on or outside any of the walls of the cabinet. In the examples illustrated by FIGS. 7 and 9, the insulation member 16 is oriented such that a dense or facing layer 22 faces toward the internal source of noise 14. In one exemplary embodiment, the dense or facing layer 22 that faces the source of noise 14 is configured to allow a majority of low frequency sound energy that is transferred from the internal source of noise 14 to the cabinet 18 to pass into the dense or facing layer 22 and into the sound absorbing layer 20. In the example illustrated by FIG. 8, the insulation member 16 is oriented such that a porous, sound absorbing layer 20 faces toward the internal source of noise 14.

Figure 10:
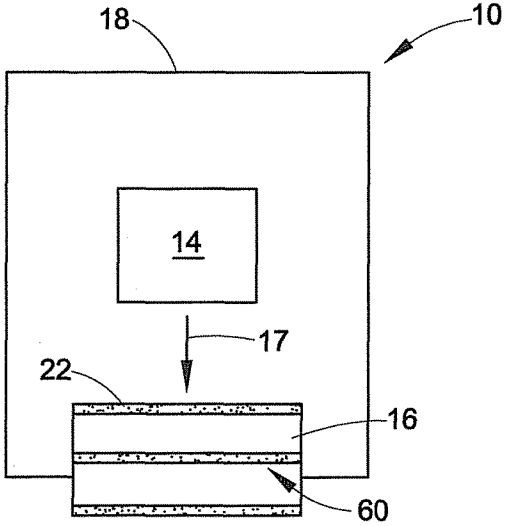
FIG. 10 is a schematic illustration of an exemplary embodiment of an acoustically insulated machine having a multi-layer acoustic insulation member.

In the example illustrated by FIG. 10, the insulation member 16 is disposed in an opening 60 of the cabinet. For example, the insulation member 16 may be disposed in an opening 60 in any of the walls of the cabinet. In an exemplary embodiment, the insulation member is soft and/or flexible enough to be folded and/or compressed to fit into the opening 60. In this embodiment, the insulation member 16 is also resilient enough to substantially return to its original size and shape to retain the insulation member 16 in the opening 60 without requiring fasteners, adhesive or other means for holding the insulation member 16 in the opening 60. In the example illustrated by FIG. 10, the insulation member 16 is disposed in a bottom opening 60 of the cabinet 18. In the example illustrated by FIG. 10, the insulation member 16 is oriented such that a dense or facing layer 22 faces toward the internal source of noise 14. In another embodiment, the insulation member 16 is oriented such that a porous, sound absorbing layer 20 faces toward the internal source of noise 14.

Figure 12:
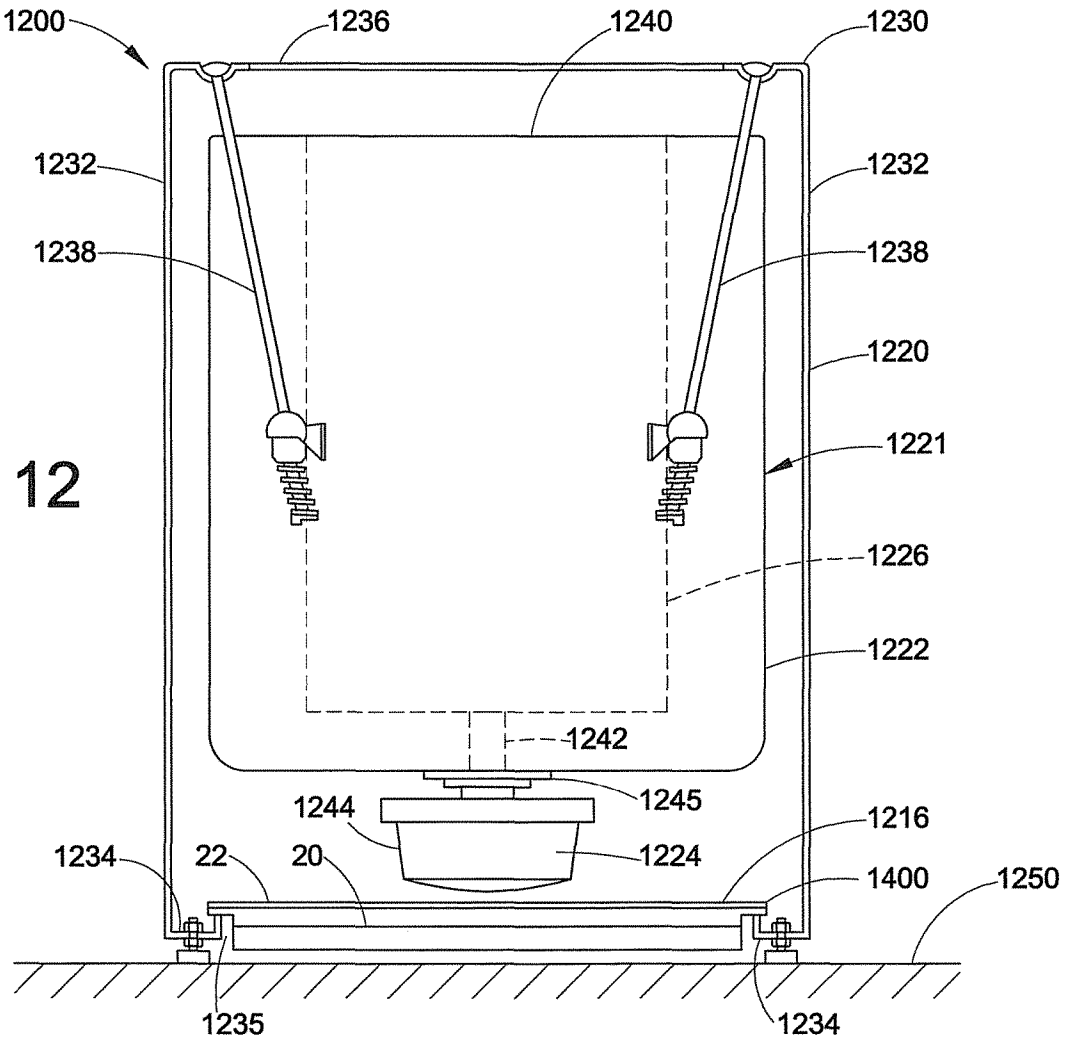
FIG. 12 is a schematic illustration of an exemplary embodiment of an acoustically insulated washing machine.

The acoustically insulated machine 10 may take a wide variety of different forms. For example, the acoustically insulated machine 10 may be a clothes washing machine, a dishwasher, an air conditioner, a microwave oven, a refrigerator, a freezer, or any other household machine or appliance that makes noise. FIG. 12 illustrates an exemplary embodiment of an acoustically insulated clothes washing machine 1200. The clothes washing machine 1200 may be any type of clothes washing machine, including top loading and front loading washing machines. The non-limiting example illustrated by FIG. 12 is a top loading washing machine. The term "top loading", as used herein, is defined to mean that an internal basket configured to retain laundry items during the washing cycle is oriented in an upright position and that the laundry items enter the basket from a top opening in the washing machine 10. However, the concepts of the acoustically insulated washing machine 1200 can be applied to any type of washing machine.

The illustrated washing machine 1200 includes a cabinet 1220, a washing assembly 1221, a motor assembly 1224 and an acoustic insulating member 1216. As shown in FIG. 12, the cabinet 1220 is configured to provide an enclosure for the internal components of the washing machine 1200. The illustrated cabinet 1220 includes a top surface 1230, side surfaces 1232 and bottom frame flanges 1234 that surround a bottom opening 1235. However, the cabinet 1220 can take a variety of different forms. The cabinet 1220 can be made from sheet metal and covered with a finish such as an enamel based finish. The cabinet can be made from a wide variety of different materials and/or combinations of materials. Examples of suitable materials for the cabinet include, but are not limited to plastic, fiberglass reinforced plastic, any type of sheet metal, etc. The cabinet 1220 may have any finish. The cabinet 1220 can be made from stainless steel sheet metal, and can have other desired finishes, such as for example a clear lacquer finish. The top surface 1230 of the cabinet includes an opening 1236 for accepting clothes. In the embodiment where the washing machine is a front loading washing machine, the opening 1236 would be provided on the front wall of the cabinet 1220.

Referring again to the example of FIG. 12, the illustrated washing assembly 1221 includes a tub 1222 and a basket 1226. Since the illustrated washing machine 1200 is a top loading machine, the tub and basket 1222, 1226 are vertically oriented. In a front loading washing machine, the tub and basket will be oriented and configured differently. It should be appreciated that the top loading machine is described only to provide an example and the acoustic insulation 1216 can be used with any type of clothes washing machine.

In the embodiment illustrated by FIG. 12, the tub 1222 is suspended within the cabinet 1220 and is configured to retain water used for washing the laundry items. The tub 1222 can take a wide variety of different forms and can be made from a wide variety of different materials. The tub 1222 may be generally cylindrical with an open top 1240 as shown, but may take a variety of different shapes. The tub may be made from plastic/polymeric materials, or metals, such as steel stainless steel, and aluminum. Preferably, the tub is made from a material that is resistant to corrosion when exposed to water or at least the inside surface of the tub is coated with a material that is resistant to corrosion when exposed to water.

As shown in the example of FIG. 12, the tub 1222 is connected to ends of a plurality of suspension devices 1238. The other ends of the suspension devices 1238 being coupled to the cabinet 1220. In the illustrated embodiment, the suspension devices 1238 are coupled to the top surface 1230 of the cabinet 1220. The suspension devices 1238 are configured to allow some vertical movement of the tub 1222 with respect to the cabinet 1220 while limiting rotational movement of the tub 1222 with respect to the cabinet 1220. However, the tub 1222 may be coupled to the cabinet 1220 in a wide variety of different ways. In the illustrated embodiment, the suspension devices 1238 are a combination of rods, springs and attachment mechanisms. In other embodiments, the suspension devices 1238 can be any desired structure, mechanism or device sufficient to suspend the tub 1222 within the cabinet 1220. The suspension devices 1238 may allow vertical movement of the tub 1222 with respect to the cabinet 1220 or otherwise couple the tub 1222 to the cabinet 1220.

Referring again to the example illustrated by FIG. 12, the motor assembly 1224 is positioned below the tub 1222. The illustrated motor assembly 1224 is configured to rotate the basket 1226 via shaft 1242. However, the motor assembly 1224 may take a wide variety of different forms and may be coupled to the basket 1226 in many different ways. The illustrated motor assembly 1224 includes an external rotor 1244 connected to the shaft 1242 with a stator of the motor being secured to the tub 1222 by a connection 1245. Alternatively, the motor assembly 1224 may include an external stator that is secured to the tub 1222 with the internal rotor connected to shaft 1242. Any rotor/stator configuration and coupling to the basket 1226 may be employed.

Referring again to the example illustrated by FIG. 12, the basket 1226 is positioned within the tub 1222 and configured to retain the laundry items during the washing cycle. The basket 1226 can take a wide variety of different forms and can be made from a wide variety of different materials. The basket 1226 may be generally cylindrical with an open top as shown, but may take a variety of different shapes. The basket may be made from plastic/polymeric materials, or metals, such as steel, stainless steel, and aluminum. Preferably, the basket is made from a material that is resistant to corrosion when exposed to water or the tub is coated with a material that is resistant to corrosion when exposed to water.

Figure 13:
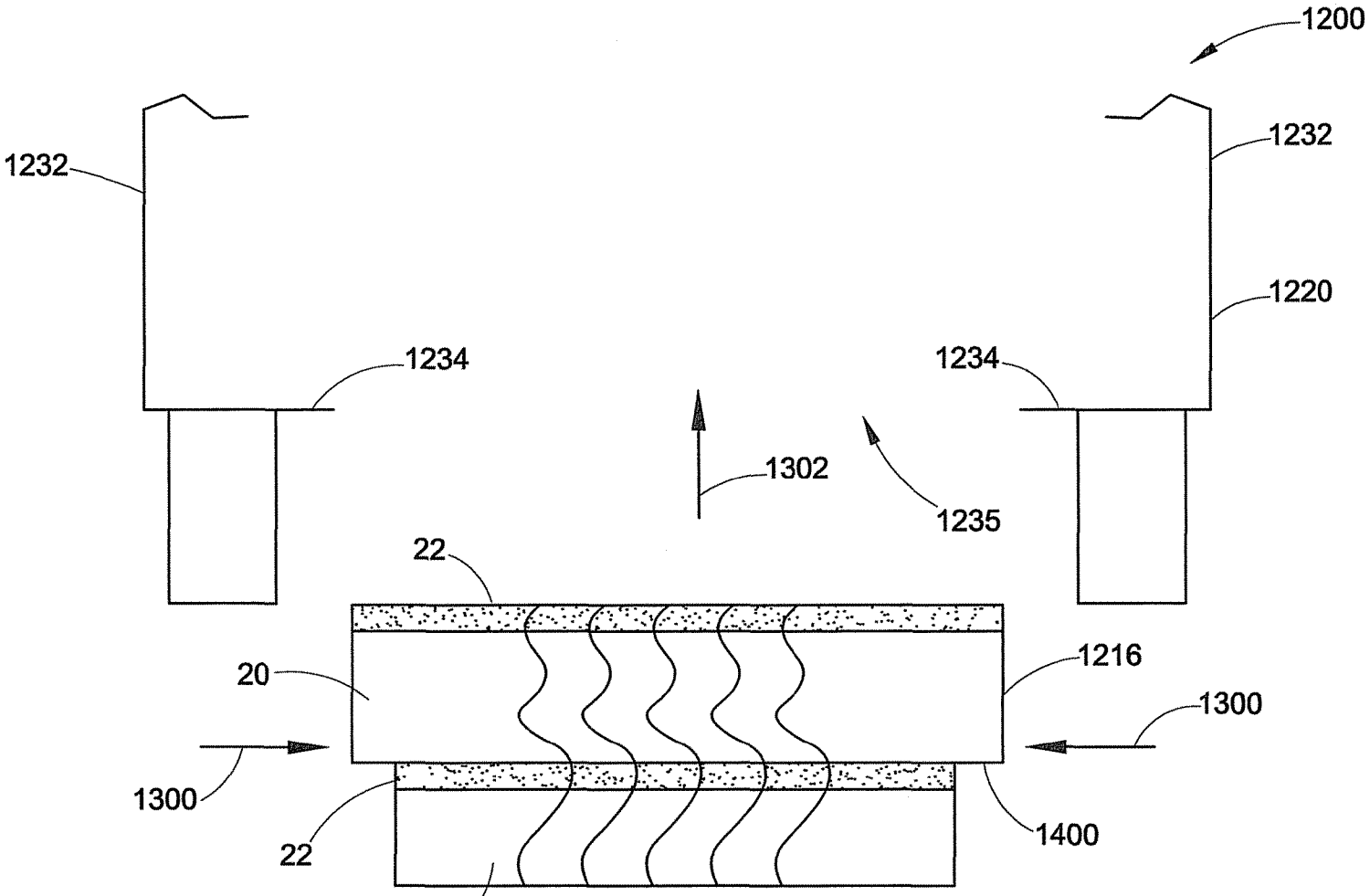
FIG. 13 is a schematic illustration of an acoustic insulation member being installed in a bottom opening of a washing machine.
Figure 14:
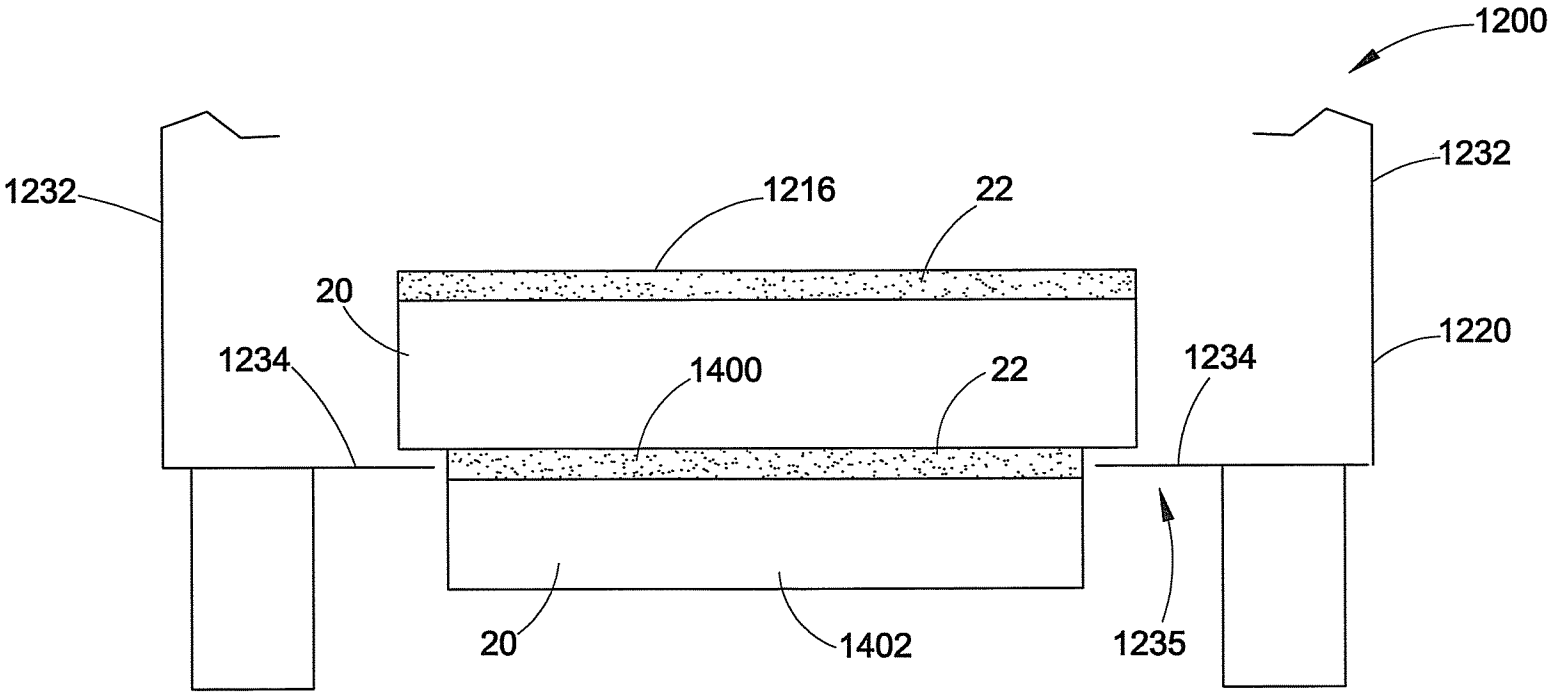
FIG. 14 is a schematic illustration of an acoustic insulation member of FIG. 13 installed in the bottom opening of the washing machine.

Referring to FIGS. 12-14, in one exemplary embodiment, the acoustic insulation member 1216 is disposed in the bottom opening 1235 of the cabinet 1220. Referring to FIG. 13, in one exemplary embodiment the acoustic insulation member 1216 is soft and flexible. The acoustic insulation member 1216 is assembled with the cabinet 1220 by compressing or folding up the insulation member 1216 as indicated by arrows 1300. The acoustic insulation member 1216 is then moved upward as indicated by arrow 1302 to place the acoustic insulation member 1216 in the bottom opening 1235 of the cabinet 1220. Referring to FIG. 14, the acoustic insulation member is released and/or unfolded such that the acoustic insulation member 1216 is retained in the bottom opening 1235 without requiring any fasteners or adhesive. The acoustic insulation member 1216 may be sized and/or shaped in a wide variety of different ways to facilitate retention in the bottom opening 1235. In the illustrated embodiment, the acoustic insulation member 1216 includes a lip or step 1400 that engages or rests on the lip portion 1234 of the bottom opening 1235.

The acoustic insulation member 1216 is positioned between the motor 1224 and a floor 1250 that supports the cabinet 1220 of the clothes washing machine 1200. As such, the acoustic insulation member 1216 absorbs low frequency sound energy and reflects high frequency sound energy generated by the washing machine motor 1224. As such, the acoustic insulation member 1216 inhibits sound energy generated by the washing machine motor 1224 from exiting through the bottom opening 1227.

Figure 15:
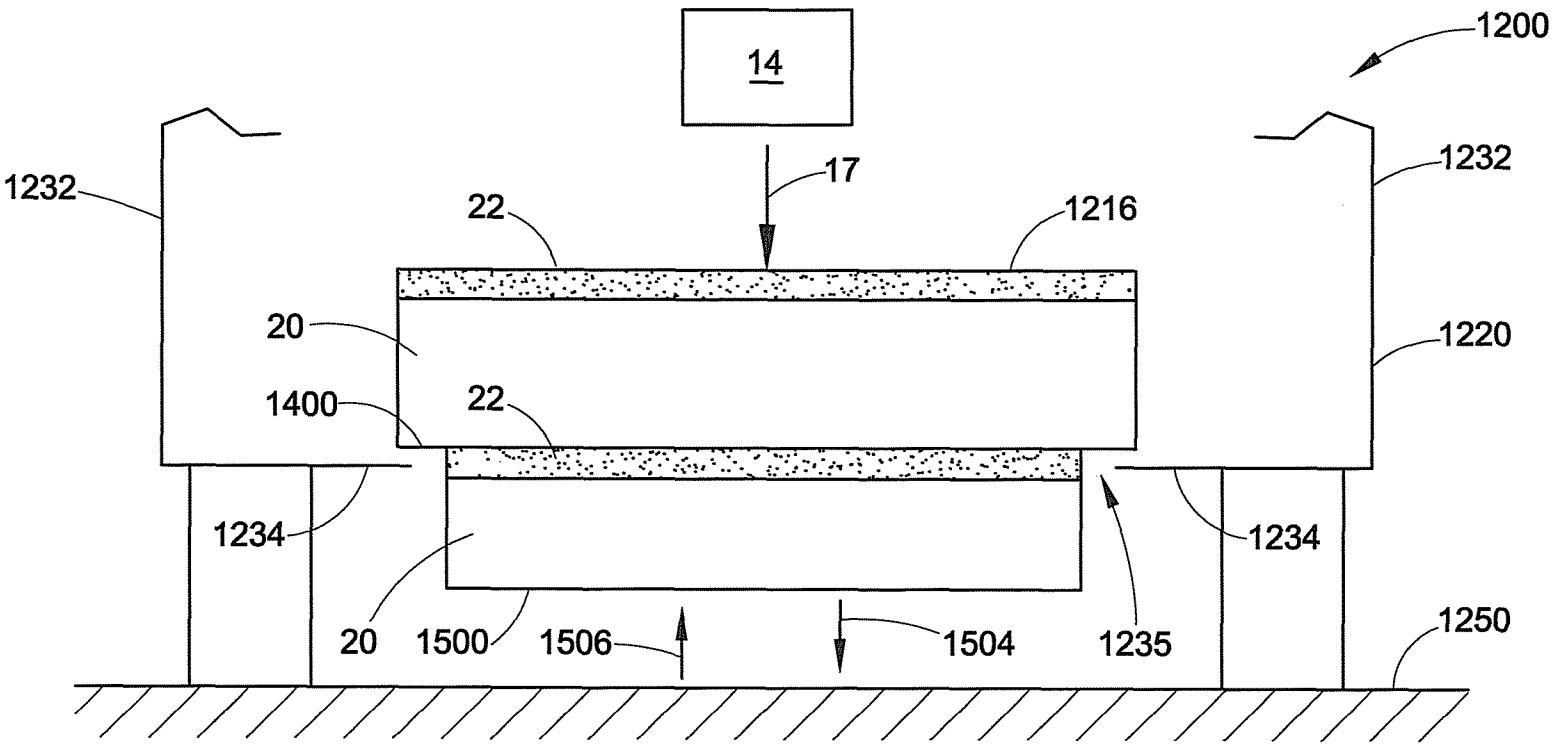
FIG. 15 is a schematic illustration of an exemplary embodiment of an acoustically insulated washing machine where the acoustic insulation member is spaced apart from the floor.

Referring to FIG. 15, in one embodiment a bottom surface 1500 of the acoustic insulation member 1216 is spaced apart from the floor 1250 that supports cabinet 1220. In this embodiment, a portion 1504 of the sound energy 1506 that leaves the acoustic insulation member 1216 is reflected off of the floor 1502 and back to the acoustic insulation member 1216. A portion of this reflected sound energy 1504 is absorbed by the acoustic insulation member 1216.

Figure 16:
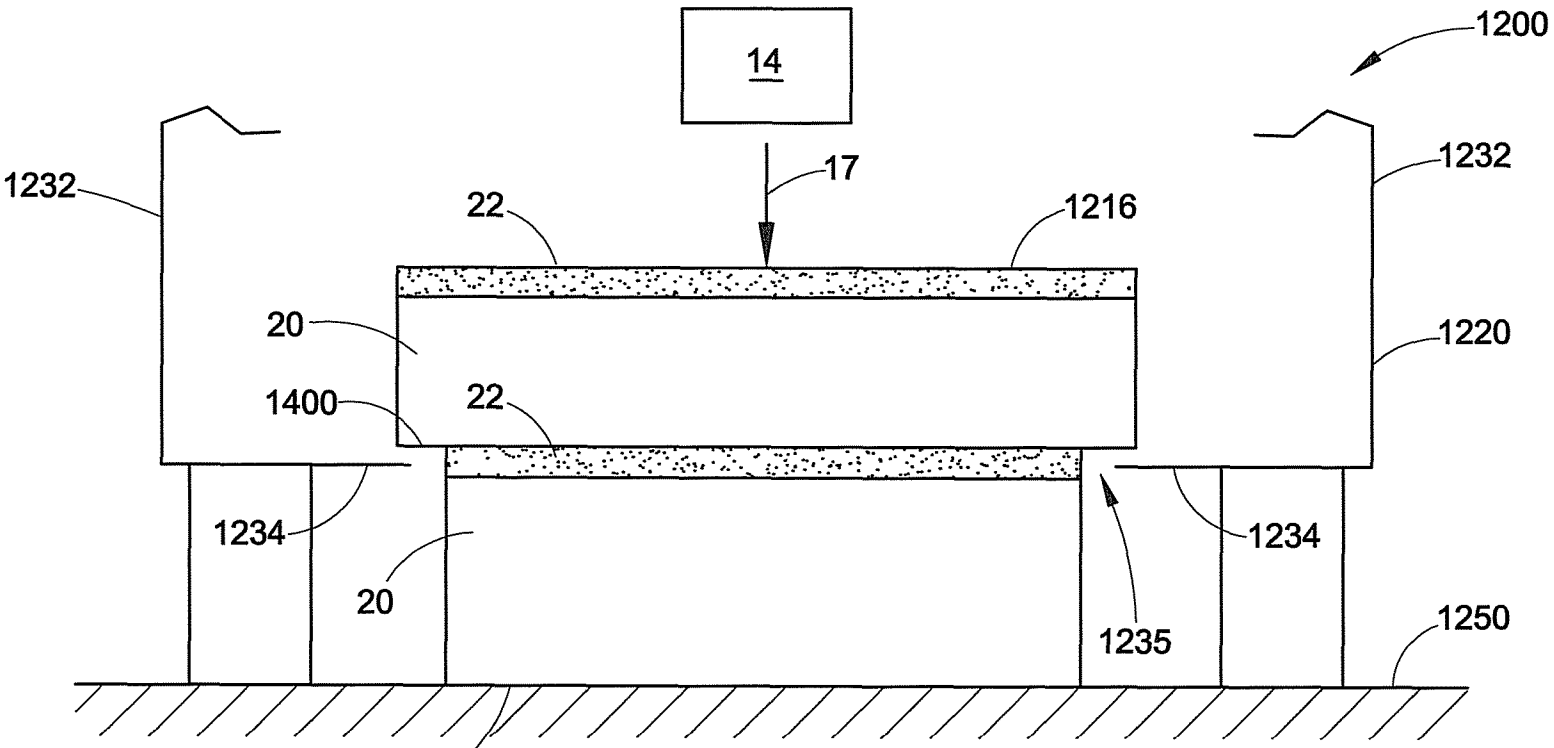
FIG. 16 is a schematic illustration of an exemplary embodiment of an acoustically insulated washing machine where the acoustic insulation member is in contact with the floor.

Referring to FIG. 16, in one embodiment a bottom surface 1600 of the acoustic insulation member 1216 is in contact with the floor 1250 that supports cabinet 1220. In this embodiment, sound energy 1506 that leaves the acoustic insulation member 1216 is reflected off of the floor 1502 and back into the acoustic insulation member 1216. The acoustic insulation member 1216 may damp vibrations of the floor to reduce noise that is transferred through the floor.

The acoustic insulation member 1216 may take a wide variety of different forms. For example, the acoustic insulation member may have any of the multi-layer configurations of the insulation member 16 described above. In addition, the acoustic insulation member 1216 may be constructed from a single layer of material having uniform properties throughout. In one exemplary embodiment, the acoustic insulation member 1216 comprises a porous, sound absorbing layer 20 and a dense or facing layer 22 attached to a first side of the sound absorbing layer 20. The dense or facing layer 22 has a density that is greater than a density of the sound absorbing layer. In one exemplary embodiment, the acoustic insulation member 1216 is oriented such that the dense or facing layer 22 faces toward the motor 1224 (see FIG. 12). The dense or facing layer 22 may be configured to allow a majority of low frequency sound energy from the motor 1224 to pass into the dense or facing layer 22. A majority of this low frequency sound energy is absorbed by the dense or facing layer 22 and the sound absorbing layer 20. In the exemplary embodiment illustrated by FIG. 14, a second or middle dense or facing layer 22 is attached to a second side 1400 of the sound absorbing layer 20. The second dense or facing layer also has a density that is greater than the density of the sound absorbing layer. A second sound absorbing layer 1402 is attached to the at least one middle dense or facing layer.

Figure 17:
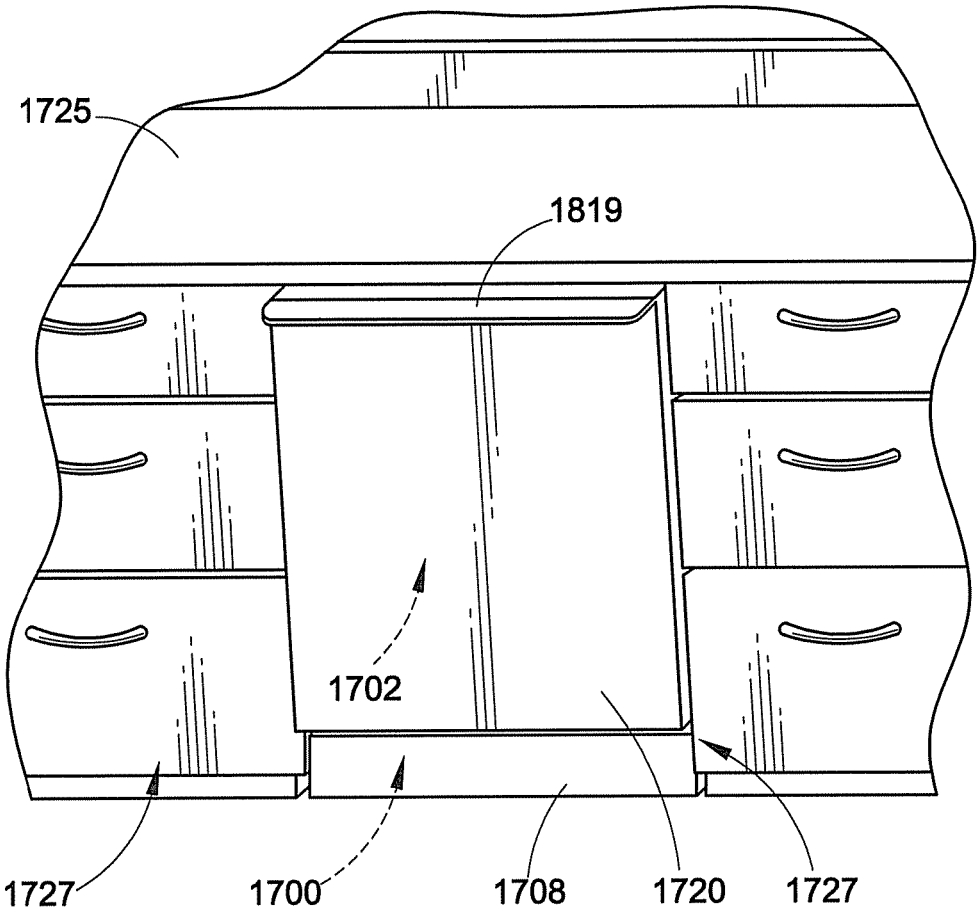
FIG. 17 is a perspective view of a dishwasher installed in kitchen cabinetry.
Figure 18:
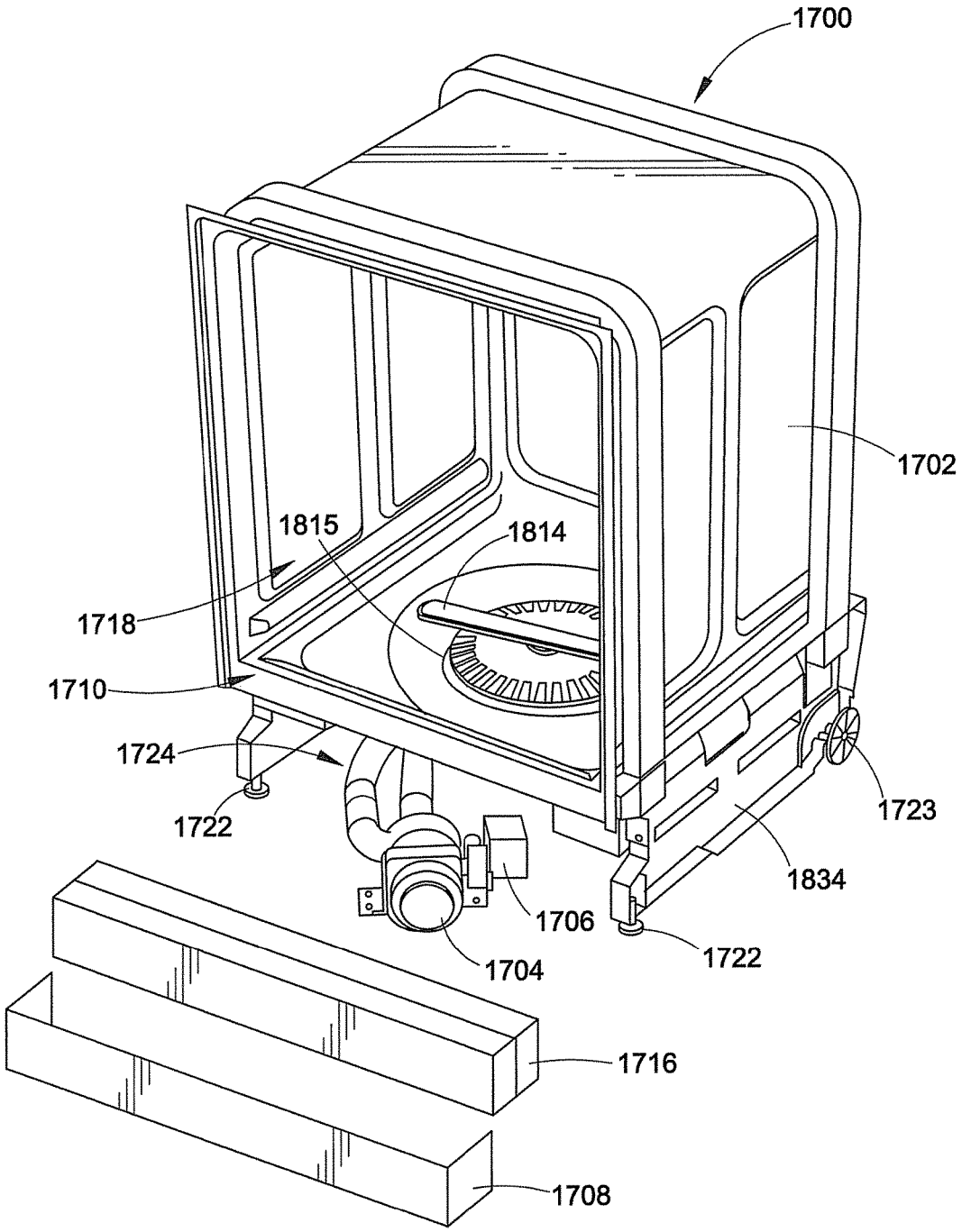
FIG. 18 is a perspective view of an exemplary embodiment of an acoustically insulated dishwasher.
Figure 19:
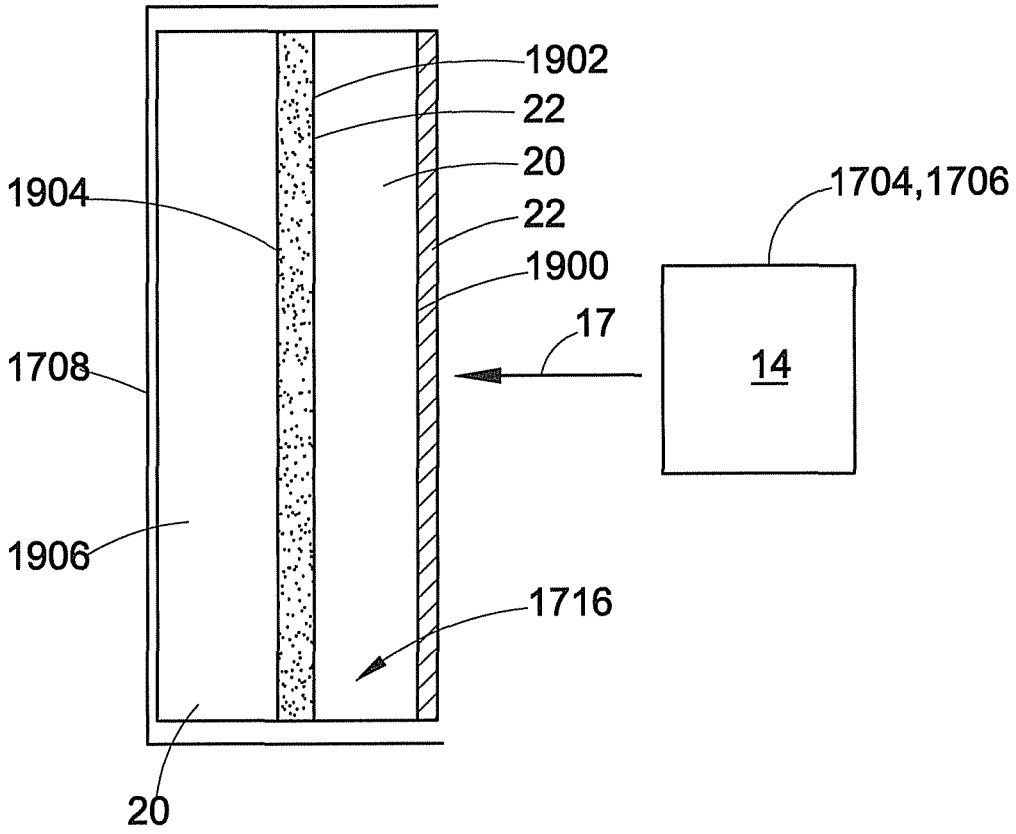
FIG. 19 is an illustration of a kick plate and acoustic insulation of an exemplary embodiment of an acoustically insulated dishwasher.

Referring to FIGS. 17-19, another exemplary embodiment of an acoustically insulated machine is an acoustically insulated dishwasher 1700. The acoustically insulated dishwasher 1700 illustrated by FIGS. 17 and 18 includes a housing 1702, a pump 1704, a drive motor 1706, a plate 1708 closing a front side 1710 of the housing, and an insulation member 1716. The housing 1702 includes a washing chamber 1718 (FIG. 18) and an access door 1720 (FIG. 17). Referring to FIG. 18, a plurality of legs 1722 or a combination of legs 1722 and wheels 1723 support the housing 1702. The pump 1704 and drive motor 1706 are provided in a cavity 1724 between the legs 1722 and below the housing 1702. The plate 1708 closes a front side of the cavity. The insulation member 1716 is disposed between the plate 1708 and the pump 1704 and drive motor 1706.

The acoustic insulation member 1716 may take a wide variety of different forms. For example, the acoustic insulation member may have any of the multi-layer configurations of the insulation member 16 described above. In one exemplary embodiment, the acoustic insulation member 1716 comprises a porous, sound absorbing layer 20 and a dense or facing layer 22 attached to a first side 1900 of the sound absorbing layer 20. The dense or facing layer 22 has a density that is greater than a density of the sound absorbing layer. In one exemplary embodiment, the acoustic insulation member 1716 is oriented such that the dense or facing layer 22 faces toward the pump 1704 and motor 1706. The dense or facing layer 22 may be configured to allow a majority of low frequency sound energy from the pump 1704 and motor 1706 to pass into the dense or facing layer 22.

In one exemplary embodiment, a second or middle dense or facing layer 1902 is attached to a second side 1904 of the sound absorbing layer 20. The second dense or facing layer also has a density that is greater than the density of the sound absorbing layer. A second sound absorbing layer 1906 is attached to the at least one middle dense or facing layer.

The insulation member 1716 may be used in a wide variety of different dishwashers. The following description of a dishwasher is provided for illustrative purposes only and is not intended to limit the scope of the application unless otherwise stated. The dishwasher 1700 illustrated by FIG. 18 includes a wash arm 1814 that is arranged within washing chamber 1718 above a sump 1815. A wash arm 1814 selectively delivers jets of washing fluid onto kitchenware placed within dishwasher 1700 in a manner known in the art. Referring to FIG. 17, the illustrated dishwasher includes a door 1720 having a handle 1819 that selectively provides access to washing chamber 1718. The door 1720 includes a plurality of control elements (not shown) for selecting particular operating parameters of a washing operation. In the embodiment shown in FIG. 17, the dishwasher 1700 is arranged below a countertop 1725 adjacent to cabinetry 1727 and is provided with a toe kick plate 1708 that extends below door 1720 to provide a finished, aesthetic appearance. In the exemplary illustrated embodiment, the insulation member 1717 is provided between the toe kick plate 1708 and the pump 1704.

As shown in FIG. 18, dishwasher 1700 includes a base portion 1834 that is provided with a pair of rear wheels, one of which is indicated at 1723, that enable an installer to easily position dishwasher 1700 below the countertop 1825, and a pair of leveling legs, one of which is shown at 1722, that enable the installer to accurately position/level the dishwasher 1700. In another embodiment, the wheels 1723 are replaced with a pair of rear legs 1722. The pump 1704 and drive motor 1706 are provided in a cavity 1724 between the legs 1722 and below the housing 1702. The wash pump 1704 is connected to sump 1815. In operation, wash pump 1704 creates a circulating flow of washing fluid within washing chamber 1718 during a washing operation.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasable or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions--such as alternative materials, structures, configurations, methods, devices and components, alternatives as to faun, fit and function, and so on--may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or aiming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The invention claimed is:

1. An acoustically insulated machine comprising:

a machine having an internal source of noise;

an insulation member comprising a plurality of porous, sound absorbing layers and a plurality of dense layers attached to faces of the sound absorbing layers;

wherein the porous, sound absorbing layers are made from a material comprising polyethylene terephthalate;

wherein the dense layers have densities that are greater than densities of the sound absorbing layers;

wherein the insulation member is oriented such that at least one of the dense layers faces toward the internal source of noise;

wherein each dense layer that faces the internal source of noise is configured to allow a majority of airborne acoustic energy having frequencies in the range of 100 to 500 Hz from the internal source of noise to pass through each dense layer that faces the internal source of noise into an adjacent porous, sound absorbing layer in the insulation member; and wherein at least one of the dense layers has an airflow resistance between 600 and 1,400 Rayls and a thickness between 0.01 and 0.1 centimeters.

2. The acoustically insulated machine of claim 1, wherein the machine is a clothes washing machine, the source of noise is a motor of the clothes washing machine, and the insulation member is positioned between the motor and a floor that supports a frame of the clothes washing machine.

3. The acoustically insulated machine of claim 1, wherein the machine is a dishwasher, the source of noise is a pump of the dishwasher, and the insulation member is positioned between the pump and a front of the dishwasher.

4. The acoustically insulated machine of claim 1, wherein each of the dense layers has an airflow resistance between 600 and 1,400 Rayls.

5. The acoustically insulated machine of claim 1, wherein each of the porous, sound absorbing layers has a density between 15 and 300 grams per square foot (161 and 3,229 grams per square meter) and wherein each of the porous sound absorbing layers has a thickness in the range of 0.5 to 3 inches (1.3 to 7.6 centimeters).

6. The acoustically insulated machine of claim 1, wherein each dense layer that faces the internal source of noise is configured to allow a majority of airborne acoustic energy having frequencies in the range of 100 to 200 Hz from the internal source of noise to pass through each dense layer that faces the internal source of noise into an adjacent porous, sound absorbing layer in the insulation member.

7. A washing machine comprising:

a cabinet having a front or top opening for accepting clothes and a bottom opening having at least one lip portion;

a washing assembly disposed in the cabinet configured to accept clothes to be washed by the washing machine through the front or top opening;

a motor assembly disposed in the cabinet and coupled to the washing assembly for operating the washing assembly; and an acoustic insulation member disposed in the bottom opening of the cabinet, wherein the acoustic insulation member is soft and flexible such that the acoustic insulation member is assembled with the cabinet by folding up the acoustic insulation member, placing the acoustic insulation member in the bottom opening of the cabinet, and unfolding the acoustic insulation member such that the acoustic insulation member engages the at least one lip portion to thereby retain the acoustic insulation member in the bottom opening;

wherein the acoustic insulation member has a plurality of porous, sound absorbing layers and a plurality of dense layers attached to faces of the sound absorbing layers;

wherein each of the porous, sound absorbing layers is made from a material comprising polyethylene terephthalate;

wherein at least one of the dense layers is perforated and has an airflow resistance between 600 and 1,400 Rayls and a thickness between 0.01 and 0.1 centimeters; and wherein the dense layers are configured to allow a majority of airborne acoustic energy having frequencies in the range of 100 to 500 Hz from the motor to pass through the dense layers into adjacent porous, sound absorbing layers in the insulation member.

8. The washing machine of claim 7, wherein the acoustic insulation member is assembled within the cabinet without the use of fasteners or adhesives.

9. The washing machine of claim 7, wherein the acoustic insulation member is spaced apart from a floor that supports the cabinet.

10. The washing machine of claim 7, wherein the acoustic insulation member engages a floor that supports the cabinet.

11. The washing machine of claim 7, wherein the plurality of dense layers have densities that are greater than densities of the sound absorbing layers; and wherein the insulation member is oriented such that one of the dense layers faces toward the motor.

12. The washing machine of claim 11, wherein each of the dense layers has an airflow resistance between 600 and 1,400 Rayls.

13. The washing machine of claim 11, wherein each of the porous, sound absorbing layers has a density of between 15 and 300 grams per square foot (161 and 3,229 grams per square meter); and wherein each of the porous sound absorbing layers has a thickness between 0.5 to 3 inches (1.3 to 7.6 centimeters).

14. The washing machine of claim 7, wherein the dense layers are configured to allow a majority of airborne acoustic energy having frequencies in the range of 100 to 200 Hz from the motor to pass into adjacent porous, sound absorbing layers in the insulation member.

15. A dishwasher comprising:

a housing including a washing chamber and an access door;

a plurality of legs supporting the housing;

a pump and drive motor provided in a cavity between the legs and below the housing;

a plate closing a front side of the cavity;

an insulation member provided between the plate and the pump and drive motor, the insulation member comprising: a plurality of porous, sound absorbing layers and a plurality of dense layers attached to faces of the sound absorbing layers;

wherein the porous, sound absorbing layers are made from a material comprising polyethylene terephthalate;

wherein the dense layers have densities that are greater than densities of the sound absorbing layers;

wherein the insulation member is oriented such that at least one of the dense layers faces toward the pump and drive motor;

wherein the dense layers that face the pump and drive motor are configured to allow a majority of airborne acoustic energy having frequencies in the range of 100 to 500 Hz from the pump and motor to pass through the dense layers facing the pump and drive motor into an adjacent porous, sound absorbing layer in the insulation member; and wherein at least one of the plurality of dense layers has an airflow resistance between 600 and 1,400 Rayls and a thickness between 0.01 and 0.1 centimeters.

16. The dishwasher of claim 15, wherein each of the dense layers each has an airflow resistance between 600 and 1,400 Rayls.

17. The dishwasher of claim 15, wherein each of the porous, sound absorbing layers has a density between 15 to 300 grams per square foot (161 to 3229 grams per square meter) and a thickness in the range of 0.5 to 3 inches (1.3 to 7.6 centimeters).

18. The acoustically insulated machine of claim 1, wherein the porous, sound absorbing layers include a first sound absorbing layer and a second sound absorbing layer;

wherein the first sound absorbing layer has a density between 20 to 25 grams per square foot (215 to 269 grams per square meter) and a thickness of ¾ inch (1.9 centimeters); and wherein the second sound absorbing layer has a density of between 60 to 80 grams per square foot (646 to 861 grams per square meter) and a thickness of 1½ inches (3.8 centimeters).

19. The washing machine of claim 7, wherein the porous, sound absorbing layers include a first sound absorbing layer and a second sound absorbing layer;

wherein the first sound absorbing layer has a density of between 20 to 25 grams per square foot (215 to 269 grams per square meter) and a thickness of ¾ inch (1.9 centimeters); and wherein the second sound absorbing layer has a density of between 60 to 80 grams per square foot (646 to 861 grams per square meter) and a thickness of 1½ inches (3.8 centimeters).

20. The dishwasher of claim 15, wherein the dense layers that face the pump and drive motor are configured to allow a majority of airborne acoustic energy having frequencies in the range of 100 to 200 Hz from the pump and motor to pass through the dense layers facing the pump and drive motor into an adjacent porous, sound absorbing layer in the insulation member.

* * * * *